US010130972B2

(12) United States Patent
Pahl et al.

(10) Patent No.: US 10,130,972 B2
(45) Date of Patent: Nov. 20, 2018

(54) HIGH SPEED INTERMITTENT BARRIER NOZZLE

(71) Applicant: Illinois Tool Works Inc., Glenview, IL (US)

(72) Inventors: Andreas Pahl, Erkrath (DE); Edward W. Bolyard, Jr., Old Hickory, TN (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

(21) Appl. No.: 15/259,388

(22) Filed: Sep. 8, 2016

(65) Prior Publication Data

US 2017/0065987 A1 Mar. 9, 2017

Related U.S. Application Data

(60) Provisional application No. 62/215,983, filed on Sep. 9, 2015.

(51) Int. Cl.
*B05B 1/12* (2006.01)
*B05D 1/02* (2006.01)
(Continued)

(52) U.S. Cl.
CPC ..... *B05D 1/02* (2013.01); *B05C 5/027* (2013.01); *B05B 7/08* (2013.01); *B05C 11/1034* (2013.01)

(58) Field of Classification Search
CPC ..... B05B 7/08; B05C 11/1034; B05C 5/027; B05D 1/02
(Continued)

(56) References Cited

U.S. PATENT DOCUMENTS 4,891,249 A 1/1990 Mcintyre
2007/0125877 A1 6/2007 Zillig et al.
2009/0258138 A1 10/2009 Burmester et al.

FOREIGN PATENT DOCUMENTS

EP 0835952 A1 4/1998
EP 0872580 A1 10/1998
EP 872580 A1 * 10/1998

OTHER PUBLICATIONS

International Search Report issued by ISA/EPO in connection with PCT/US2016/050979 dated Dec. 12, 2016.
(Continued)

*Primary Examiner* — Alexander M Weddle
(74) *Attorney, Agent, or Firm* — Levenfeld Pearlstein, LLC

(57) ABSTRACT

A nozzle assembly for applying a fluid on a substrate includes a plurality of plates, a first fluid conduit having a first inlet configured and a first discharge orifice configured to discharge a first fluid generally in a first direction, and a second fluid conduit having a second inlet, a second discharge orifice configured to discharge a second fluid generally in a second direction intersecting the first direction and a third discharge orifice. The second fluid acts on the first fluid at the first discharge orifice. A method of applying the fluid on the substrate includes continuously feeding the substrate by the nozzle assembly, discharging, in the first direction, the first fluid from the first discharge orifice onto the substrate, discharging, in the second direction, the second fluid from the second discharge orifice, and discharging, generally in the first direction, the second fluid from the third orifice.

23 Claims, 21 Drawing Sheets

(51) Int. Cl.

| | |
|---|---|
| ***B05C 5/02*** | (2006.01) |
| *B05B 7/08* | (2006.01) |
| *B05C 11/10* | (2006.01) |

(58) Field of Classification Search
USPC ..... 427/421.1; 118/300, 313
See application file for complete search history.

(56) References Cited

OTHER PUBLICATIONS

International Preliminary Report on Patentability issued by ISA/EPO in connection with PCT/US2016/050979 dated Mar. 13, 2018.

* cited by examiner

HIGH SPEED INTERMITTENT BARRIER NOZZLE

BACKGROUND

A fiberized adhesive may be applied to a substrate or strand of material using a nozzle having one or more adhesive orifices. One potential application may be in the manufacture of disposable hygiene products or articles. The products typically include a substrate, for example, a non-woven film or non-woven/film laminate material, and another component bonded to the substrate with the adhesive. For example, the fiberized adhesive may be applied to a substrate to attach a waist band to the substrate in the manufacture of a diaper, applied as a positioning adhesive on a substrate in the manufacture of a feminine hygiene product, or applied to secure a core to an outer shell in the construction of hygiene product.

The articles or products may be manufactured by feeding the substrate along the nozzle in a machine direction. The adhesive orifices of the nozzle may be arranged across a width of the nozzle, transverse to the machine direction. Thus, adhesive may be applied over a width of the substrate. In addition, the nozzle may include air orifices positioned between the adhesive orifices in a width direction of the nozzle. The discharged air may oscillate the individual adhesive fibers or strands in width direction as they are applied to the substrate.

It may be desirable to selectively stop and/or start application of the adhesive onto the substrate during manufacture of an article. For example, it may be desirable to provide an intermittent application pattern of the adhesive onto the substrate in the machine direction to allow for gaps either where bonding to the substrate is not desired or to separate adjacent parts or products to be formed from the substrate.

Intermittent application of the adhesive is typically controlled by controlling supply of the adhesive to the nozzle. To provide a gap between adhesive sections on a substrate in the machine direction, the supply of the adhesive to the nozzle may be interrupted, for example, by stopping a metering pump or actuating a valve.

However, in conventional systems, it is difficult to precisely and accurately control application of the adhesive onto the substrate to start and stop at desired positions. For example, residual adhesive in the nozzle may continue to be discharged from the nozzle orifice even after a supply of the adhesive to the nozzle has been interrupted, resulting in an over-application of adhesive to the substrate. This is commonly referred to as overspray, which leads to increased material cost and glue contamination of the product areas that should be free of adhesive. Further still, to improve positioning of the gaps, a line speed of the substrate may be reduced, resulting in increased production time.

In addition, a desired application pattern of the adhesive, as a whole, on the substrate is typically in a rectangular shape, with precisely defined lateral edges (edge definition) and ends where the adhesive starts and stops. With conventional nozzles, it may not only be difficult to precisely control the ends where the adhesive application starts or stops as described above, but to also control application of the adhesive to have a desired edge definition. For example, in conventional systems, with the air outlet or outlets laterally spaced from the adhesive outlets, the discharged adhesive may be pushed by the air beyond a desired lateral edge, again resulting in overspray.

Moreover, in conventional systems, upon startup, a delay may exist between the discharge of the adhesive and sufficient air discharge to fiberize the adhesive. Accordingly, at startup, non-fiberized, or insufficiently fiberized drops of adhesive may be received on the substrate. This may be referred to as "glue strike through." The non-fiberized drops received on the substrate may contaminate machine rollers as the substrate is fed along the machine.

Accordingly, it is desirable to provide a nozzle assembly having improved fluid startup and cut-off characteristics so that application of a fluid onto a substrate may be more accurately controlled and overspray may be reduced or limited. In addition, it is desirable to operate at increased line speeds while accurately controlling the application of the fluid onto the substrate. Further, it is desirable to provide a nozzle assembly with improved startup adhesive discharge characteristics and better lateral fluid application control.

SUMMARY

According to one embodiment there is provided a nozzle assembly for applying a fluid on a substrate. The nozzle assembly includes a plurality of plates secured together, a first fluid conduit having a first inlet configured to receive a first fluid, a first discharge orifice disposed downstream from and in fluid communication with the first fluid conduit, the first discharge orifice configured to discharge the first fluid generally in a first direction, a second fluid conduit having a second inlet configured to receive a second fluid, a second discharge orifice disposed downstream from and in fluid communication with the second fluid conduit, the second discharge orifice configured to discharge the second fluid generally in a second direction intersecting the first direction, and a third discharge orifice disposed downstream from and in fluid communication with the second fluid conduit, the third discharge orifice configured to discharge the second fluid to oscillate or vacillate the first fluid during discharge of the first fluid.

According to another embodiment there is provided a method of applying fluid on a substrate with a nozzle assembly. The nozzle assembly includes a plurality of plates secured together, a first fluid conduit having a first inlet configured to receive a first fluid, a first discharge orifice disposed downstream from and in fluid communication with the first fluid conduit, the first discharge orifice configured to discharge the first fluid in a first direction, a second fluid conduit having a second inlet configured to receive a second fluid, a second discharge orifice disposed downstream from and in fluid communication with the second fluid conduit, the second discharge orifice configured to discharge the second fluid in a second direction intersecting the first direction, and a third discharge orifice disposed downstream from and in fluid communication with the second fluid conduit, the third discharge orifice configured to discharge the second fluid to oscillate or vacillate the first fluid. The method includes continuously feeding the substrate by the nozzle assembly, discharging, in the first direction, the first fluid from the first discharge orifice onto the substrate, discharging, in the second direction, the second fluid from the second discharge orifice to cut the first fluid discharged from the first discharge orifice at the first discharge orifice and discharging the second fluid from the third discharge orifice generally in the first direction.

Other objects, features, and advantages of the disclosure will be apparent from the following description, taken in conjunction with the accompanying sheets of drawings, wherein like numerals refer to like parts, elements, components, steps, and processes.

DETAILED DESCRIPTION

Figure 2:
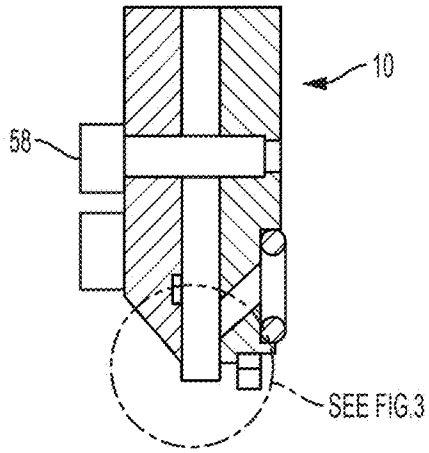
FIG. 2 is a cross-sectional view of the nozzle assembly of FIGS. 1A-1C.

While the present disclosure is susceptible of embodiment in various forms, there is shown in the drawings and will hereinafter be described one or more embodiments with the understanding that the present disclosure is to be considered illustrative only and is not intended to limit the disclosure to any specific embodiment described or illustrated.

Figure 1C:
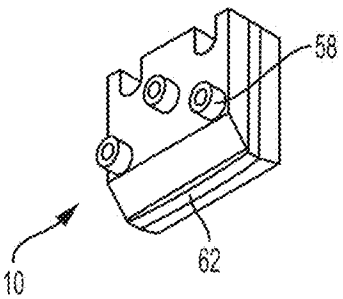
FIGS. 1A, 1B, and 1C show front, side and perspective views of a nozzle assembly according to an embodiment described herein.
Figure 1B:
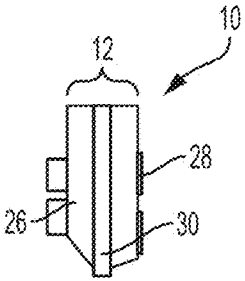
Figure 3:
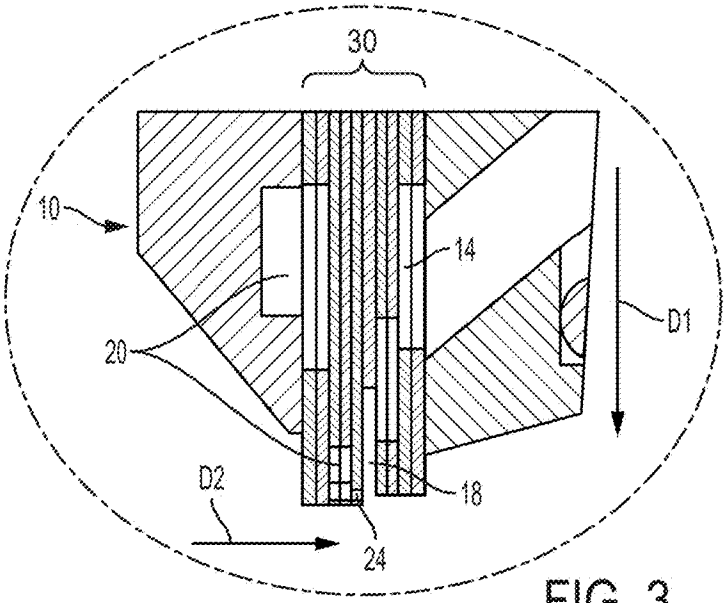
FIG. 3 is an enlarged cross-sectional view of the of a nozzle assembly according to an embodiment described herein.
Figure 1A:
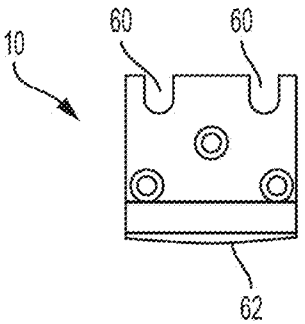
Figure 9:
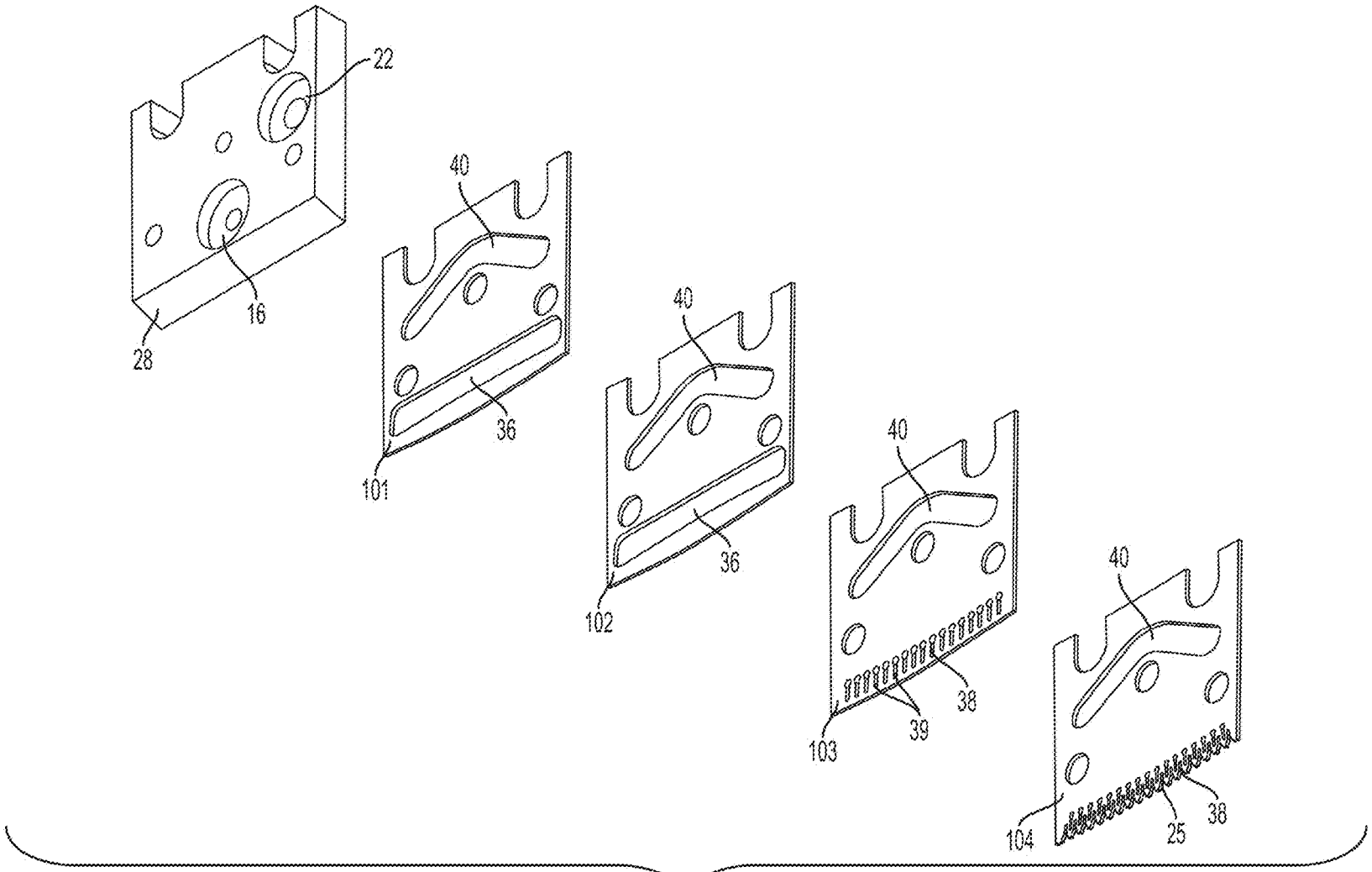
FIGS. 9-11 are enlarged view of the plates of the nozzle assembly shown in FIG. 8.
Figure 10:
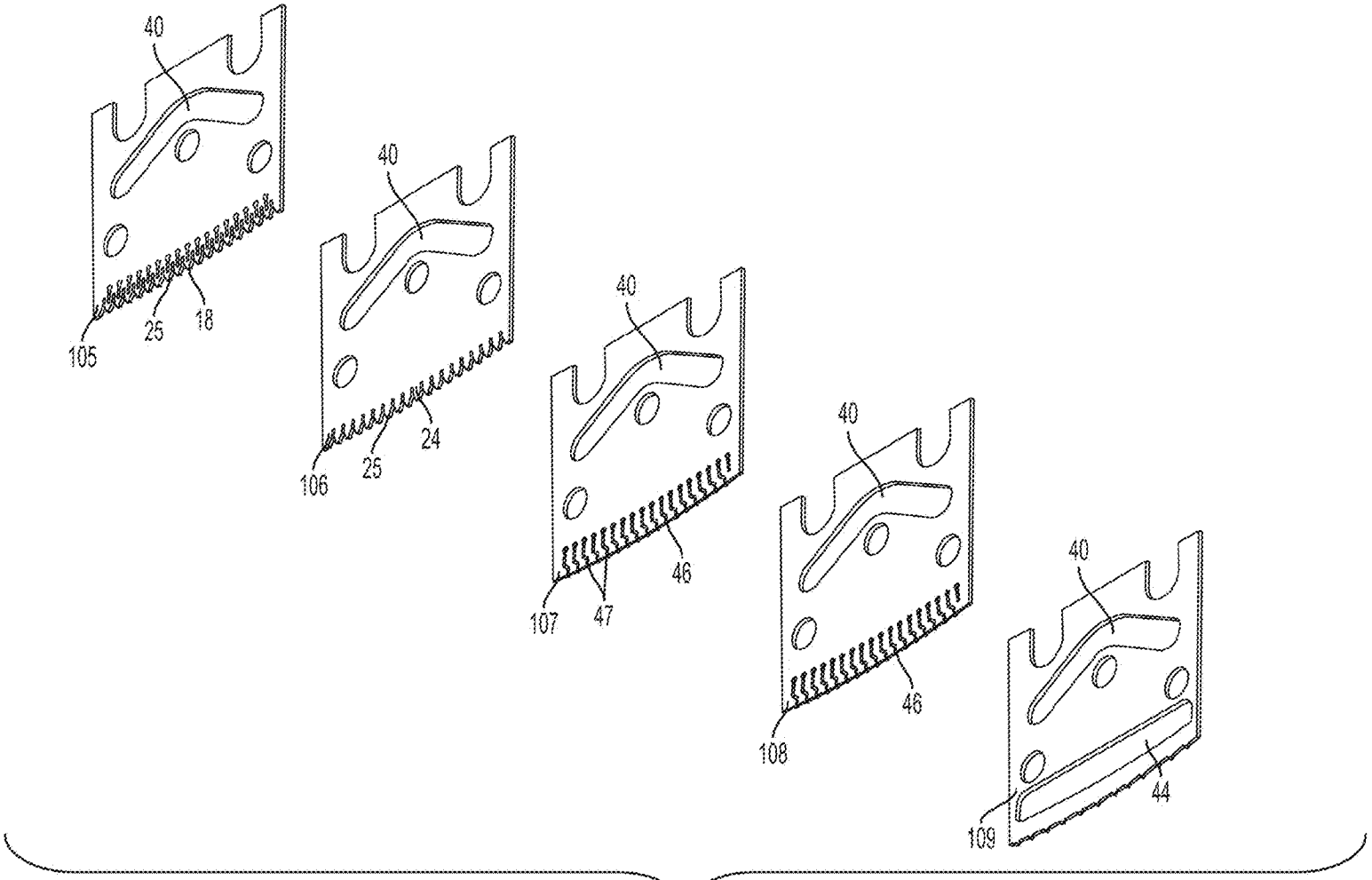
Figure 11:
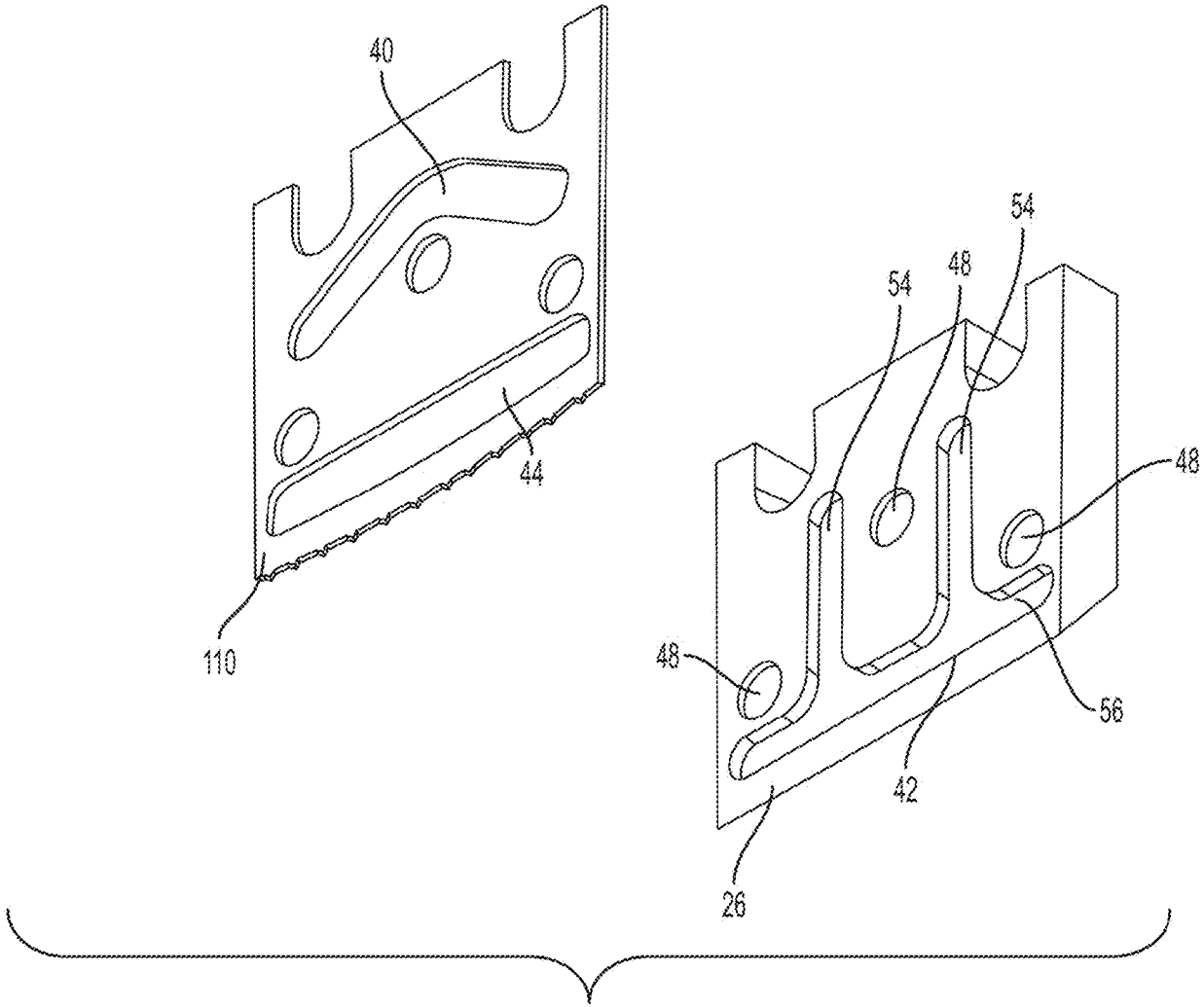

FIGS. 1A, 1B and 1C show a front view, a side view and a perspective view of a nozzle assembly 10, according to an embodiment described herein. FIGS. 2-7 show different cross-sectional views of the nozzle assembly 10, or portion of the nozzle assembly 10, according to embodiments described herein. FIG. 8 is an exploded view of the nozzle assembly 10 according to an embodiment described herein, and FIGS. 9-11 are enlarged views of features shown in FIG. 8. Referring to FIGS. 1-11, according to the embodiments described herein, the nozzle assembly 10 is configured for discharging a fluid onto a substrate and generally includes a plurality of plates 12 secured together, a first fluid conduit 14 having a first inlet 16 and one or more first discharge orifices 18, and a second fluid conduit 20 having a second inlet 22 (FIG. 8), one or more second discharge orifices 24, and one or more third discharge orifices 25 (FIG. 9).

The first fluid conduit (or plenum) 14 and first inlet 16 are configured to receive a first fluid F1 from a first fluid supply (not shown). The one or more first discharge orifices are positioned downstream from, and in fluid communication with, the first fluid conduit 14 so as to receive the first fluid F1 from the first fluid conduit 14. The second fluid conduit (or plenum) 20 and the second inlet 22 are configured to receive a second fluid F2 from a second fluid supply (not shown). The one or more second discharge orifices 24 are positioned downstream, and in fluid communication with, the second fluid conduit 20 so as to receive the second fluid F2 from the second fluid conduit 20. The one or more third discharge orifices 25 are also positioned downstream from, and in fluid communication with, the second fluid conduit 20 so as to receive the second fluid F2 from the second fluid conduit 22.

Each first discharge orifice 18 is configured to discharge the first fluid F1 (FIG. 4) generally in a first direction D1. Each second discharge orifice 24 is configured to discharge a second fluid F2 (FIG. 4) generally in a second direction D2 intersecting the first direction D1. Each third discharge orifice 25 is configured to discharge the second fluid F2 in a range of angles, generally in the first direction D1. The one or more second discharge orifices 24 may also be referred to herein as a "barrier orifice" and the one or more third discharge orifices 25 may also be referred to herein as a "spray orifice." In one embodiment, the second fluid F2 discharged from the one or more second discharge orifices 24 may act as an air knife to cut off the first fluid F1 discharged from a respective one or more first discharge orifice 22, and the second fluid F2 discharged from the one or more third discharge orifices 25 may act to oscillate or vacillate the first fluid F1 during application on the substrate. The first fluid F1 may be a hot melt adhesive and the second fluid F2 may be air. Air discharged from the one or more second or third orifices 24, 25 may also stretch the adhesive as it is discharged from the one or more first orifices 18 to fiberize the adhesive.

In one embodiment, the nozzle assembly 10 is a laminated plate nozzle (LPN) formed by the plurality of plates 12. The first fluid conduit 14 and the second fluid conduit 20 extend through one or more plates of the plurality of the plates 12. In one embodiment, the second fluid conduit 20 may extend in each plate of the plurality of the plates 12. The plurality of plates 12 may include a face plate 26, a backing plate 28 and a plurality of laminated nozzle plates 30 positioned therebetween. The first inlet 16 and the second inlet 22 may be formed in the backing plate 28. The first inlet 16 is configured to receive the first fluid F1 into the first fluid conduit 14 and the second inlet 22 is configured to receive the second fluid F2 into the second fluid conduit 20.

Figure 7:
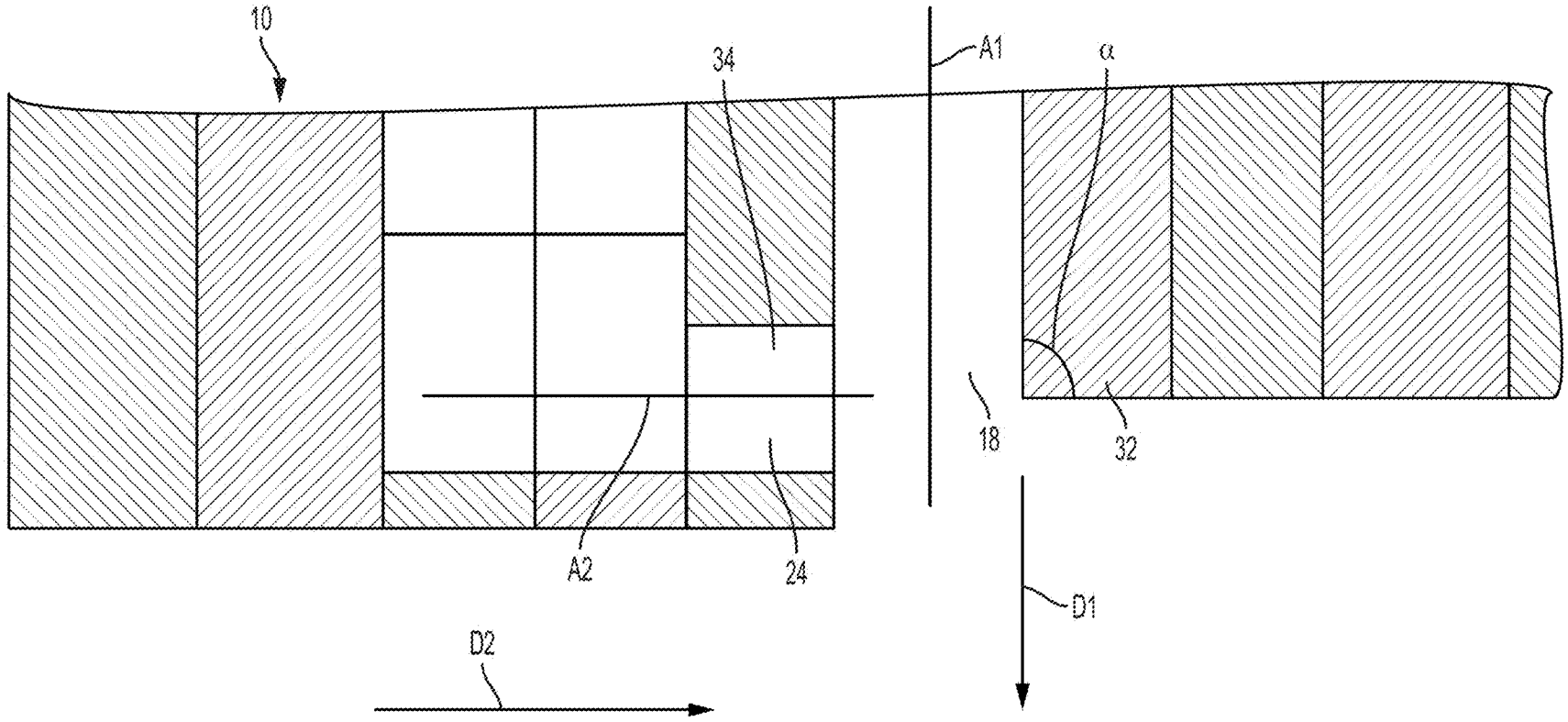
FIG. 7 is an enlarged cross-sectional view showing first and second discharge orifices in a nozzle assembly according to an embodiment described herein.
Figure 8:
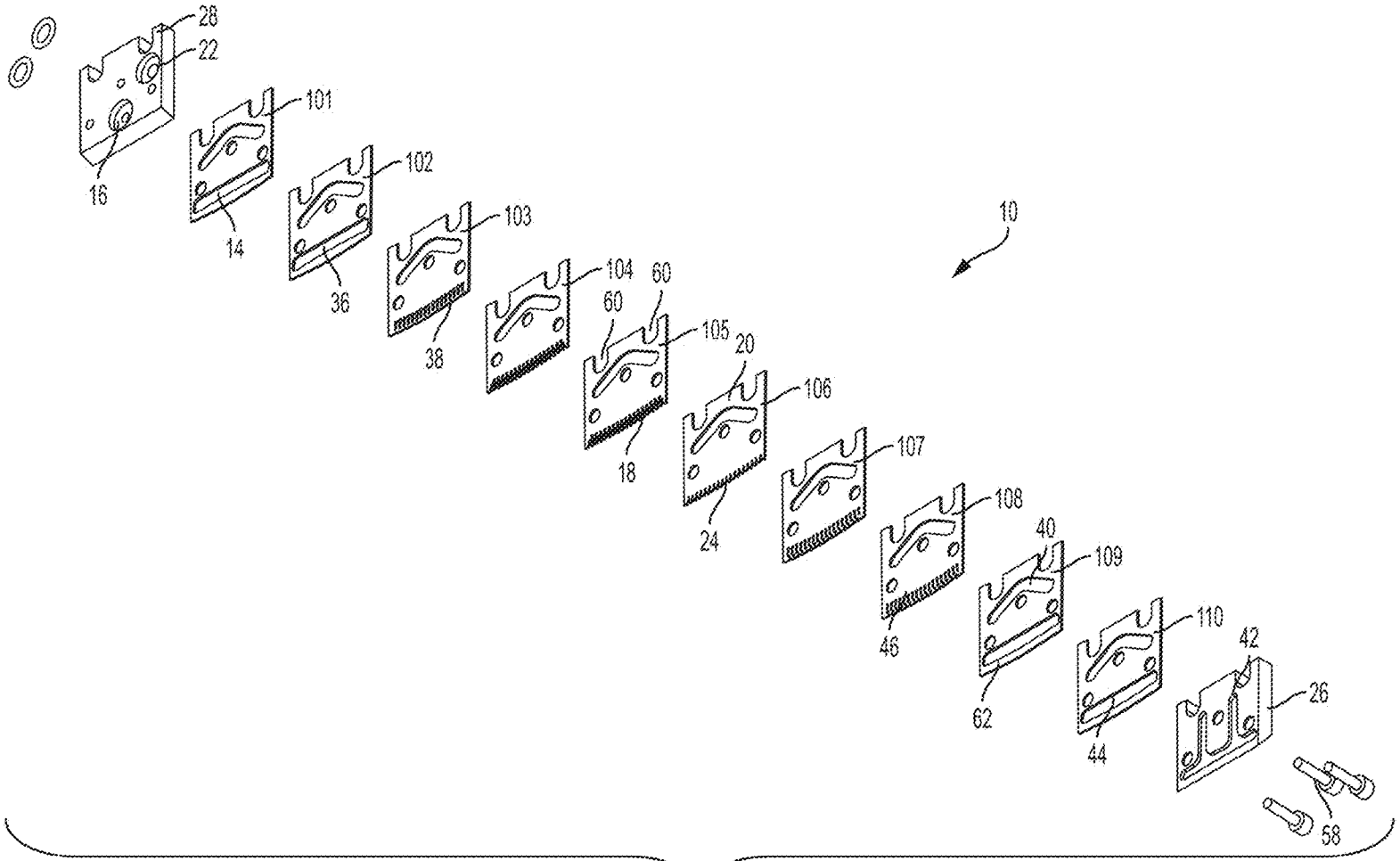
FIG. 8 is an exploded view of a nozzle assembly according to an embodiment described herein.

As shown in FIGS. 3-8, and with particular reference to FIG. 7, a first discharge orifice 18 of the one or more first discharge orifices 18 is configured to discharge the first fluid F1 generally in the first direction D1 substantially away from the nozzle assembly 10. In one embodiment, the first discharge orifice 18 has a first axis A1 that extends in the first direction D1. A second discharge orifice 24 of the one or more second discharge orifices 24 is configured to discharge the second fluid F2 generally in the second direction D2 intersecting the first direction D1. The second discharge orifice 24 may include a second axis A2 that extends in the second direction D2.

In one embodiment, the first direction D1 may be angled relative to the second direction D2 by approximately 80 degrees to 100 degrees, and preferably, by about 90 degrees. Likewise, the first axis A1 and the second axis A2 may be angled relative to each other by approximately 80 degrees to 100 degrees, and preferably, by about 90 degrees.

Figure 4:
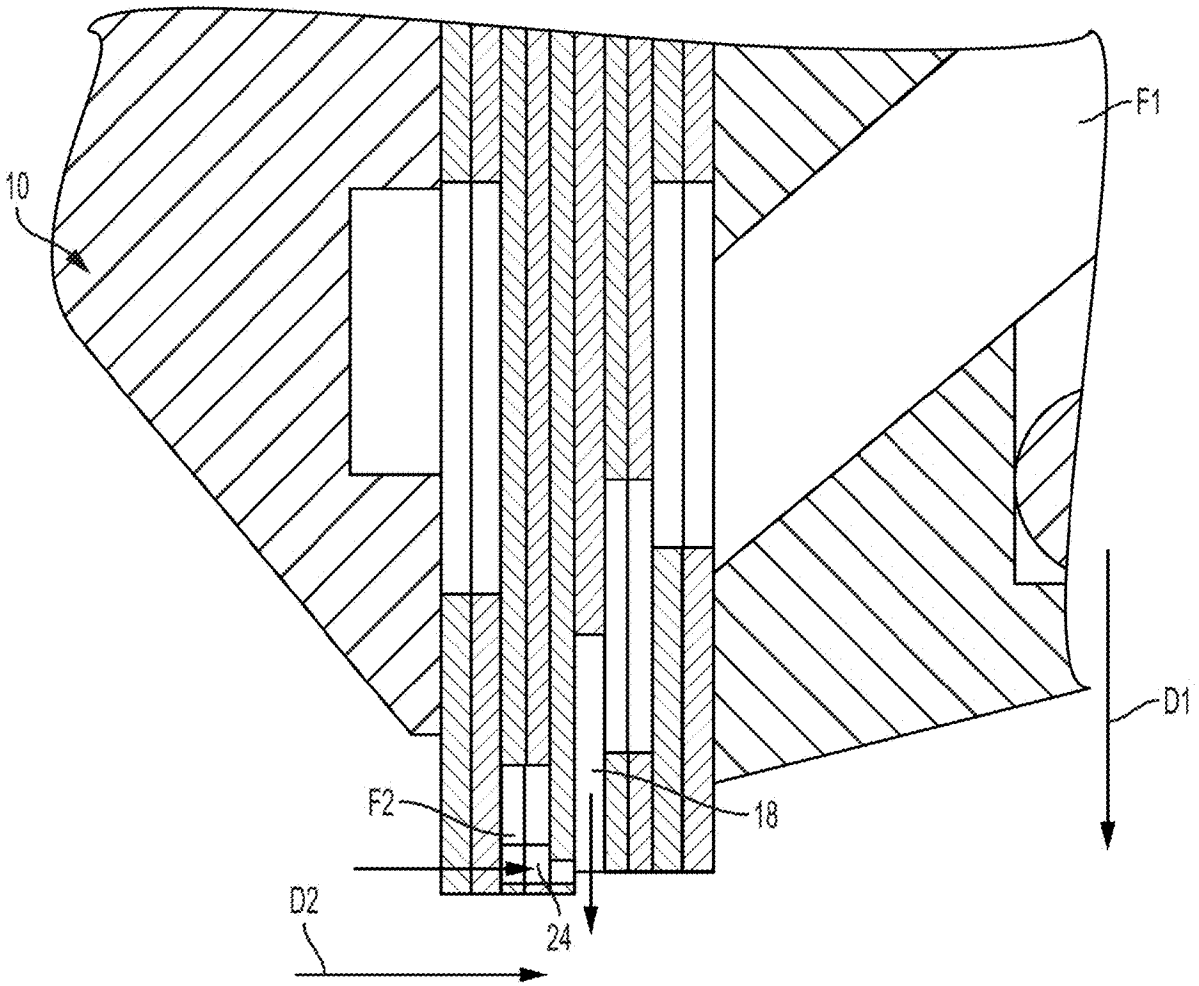
FIG. 4 is an enlarged cross-sectional view showing fluid flow in a nozzle assembly according to an embodiment described herein.

In addition, as shown in FIGS. 4 and 7, for example, the second discharge orifice 24 may discharge the second fluid F2 at least partially into the first discharge orifice 18. For example, the second discharge orifice 24 has a width, for example a diameter, such that at least a portion of the second fluid F2 may be discharged into the first discharge orifice 18. Referring to FIG. 7, in one embodiment, a midline of the second discharge orifice 24, i.e., the second axis A2, is positioned along the first direction D1 to correspond an end 32 of the first discharge orifice 18. Accordingly, fluid discharged from the second discharge orifice 24 at one side 34 of the second axis A2 may be discharged into the first discharge orifice 18. It is understood that the present disclosure is not limited to this configuration, however. For example, an eccentric, i.e., non-axial, line extending from the second discharge orifice may be aligned with the end 32 of the first discharge orifice 18. The end 32 of the first discharge orifice 18 may be defined, in part, by an end of one of the plurality of plates immediately adjacent to the first discharge orifice 18. In one embodiment, the end of the one plate includes an edge section formed at a first angle $\alpha$. The angle $\alpha$ is preferably about 90 degrees, but other angles are also envisioned. The edge section may serve as a knife-edge portion to assist in cutting or separating a fiberized strand of adhesive discharged from the first discharge orifice 18.

FIG. 8 is an exploded view of the nozzle assembly 10 showing individual plates of the plurality of plates 12 according to an embodiment described herein. FIGS. 9-11 show enlarged views of the plates shown in FIG. 8. Referring to FIGS. 8-11, the backing plate 28 may include the first and second inlets 16, 22 to receive the first and second fluids F1, F2 from respective supply sources (not shown).

In one embodiment, the first fluid conduit 14 also includes a reservoir portion 36, a first divider portion 38 and the one more first discharge orifices 18. The first divider portion 38 divides the first fluid conduit 14 into a plurality of first paths 39, each first path 39 in fluid communication with a respective first discharge orifice 18. Accordingly, the first fluid F1 may be received in the first fluid conduit 14 via the first inlet 16. For example, the first fluid F1 may be received in the reservoir portion 36 from the first inlet 16 and in the first divider portion 38 from the reservoir portion 36. The first fluid F1 may then flow to the plurality of first paths 39 in the first divider portion 38 and then to respective first discharge orifices 18. It is understood, however, that the reservoir 36 and/or first divider portion 38 may be combined or omitted in other embodiments. For example, the first inlet 26 may flow directly to the one or more first discharge orifices 18.

Referring to FIGS. 10 and 11, in one embodiment, the second fluid conduit 20 includes an upper portion 40, a connecting portion 42, a lower portion 44, a second divider portion 46, the one or more second discharge orifices 24 and the one or more third discharge orifices 25. The second divider portion 46 divides the second fluid conduit 20 into a plurality of second paths 47, each second path 47 in fluid communication with, and configured to direct the second fluid F2 to a barrier orifice 24 and a spray orifice 25. Accordingly, the second fluid F2 may be received in the second fluid conduit 20 via the second inlet 22. The second fluid F2 may be received in the upper portion 40 from the second inlet 22, in the connecting portion 42 from the upper portion 40 and in the lower portion 44 from the connecting portion 42. The second divider portion 46 and the plurality of second paths 47 may receive the second fluid F2 from the lower portion 44. It is understood that the terminology "upper" and "lower" refers to the relative orientations shown in FIG. 8 and does not limit the positions of the upper portion and lower portion to upper and lower portions, respectively, of a nozzle assembly. Further, it is understood that the different portions of the second fluid conduit 20 between the second inlet 22 and the one or more second discharge orifices 24 described above, such as the second divider portion 46, may be omitted or combined in other embodiments.

Referring to FIGS. 8-11, in one embodiment, the upper portion 40 extends through a thickness of the nozzle assembly 10 to the connecting portion 42. The upper portion 40 is configured to allow the second fluid F2 to flow in a direction from the backing plate 28 toward the face plate 26. The connecting portion 42 fluidically connects the upper portion 40 to the lower portion 44. The connecting portion 42 may be shaped to extend around fastening holes 48 formed in the nozzle assembly 10. The lower portion 44 is configured to allow the second fluid F2 to flow in a direction from the face plate 26 toward the backing plate 28 and into the second divider portion 46 and/or the one or more second discharge orifices 24.

Figure 13:
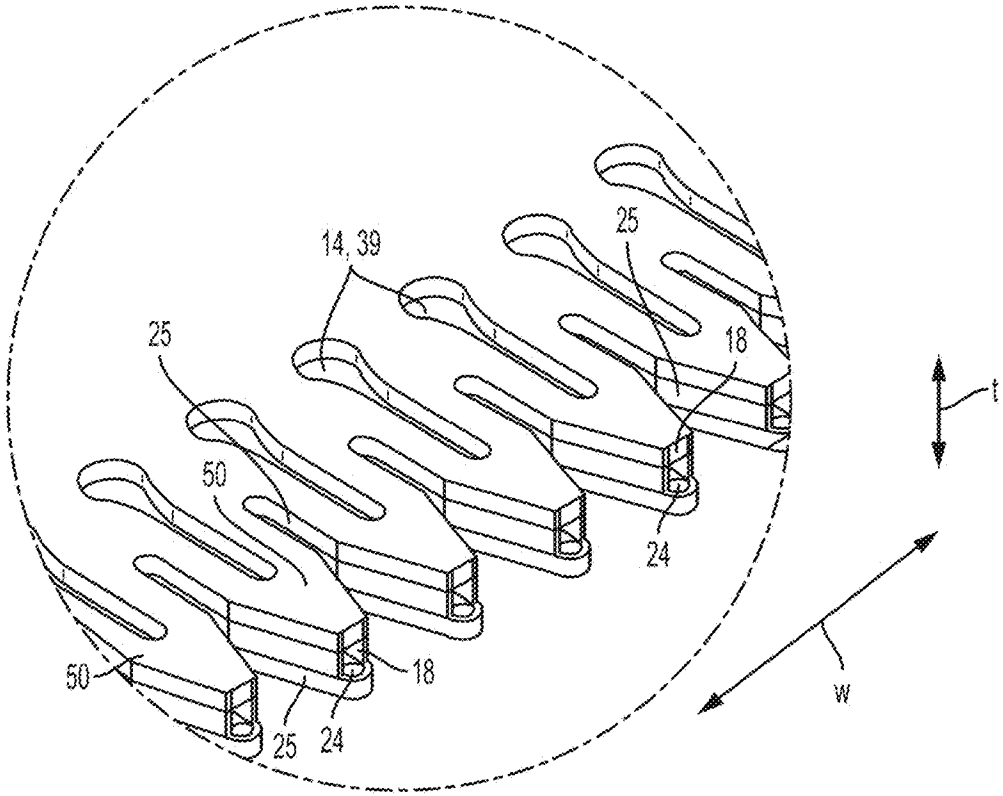
FIG. 13 is an enlarged view of a portion of the nozzle plates shown in FIG. 12.
Figure 12:
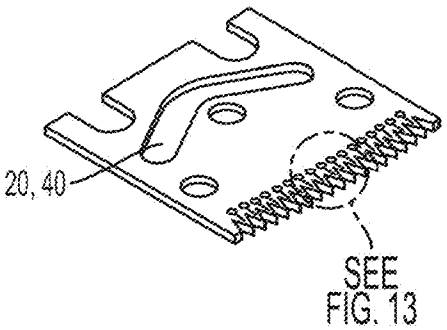
FIG. 12 shows nozzle plates having first and second discharge orifices according to an embodiment described herein.

FIG. 12 is a perspective view showing a portion of the nozzle assembly 10 according to an embodiment described herein, and FIG. 13 is an enlarged view of a portion of FIG. 12 showing the first, second and third discharge orifices 18, 24, 25. Referring to FIGS. 8-13, the nozzle assembly 10 may also include a plurality of orifice tips 50 spaced apart by corresponding third discharge orifices 25. In one embodiment, each first and second discharge orifice 18, 24 is positioned at a corresponding orifice tip 50.

Figure 14:
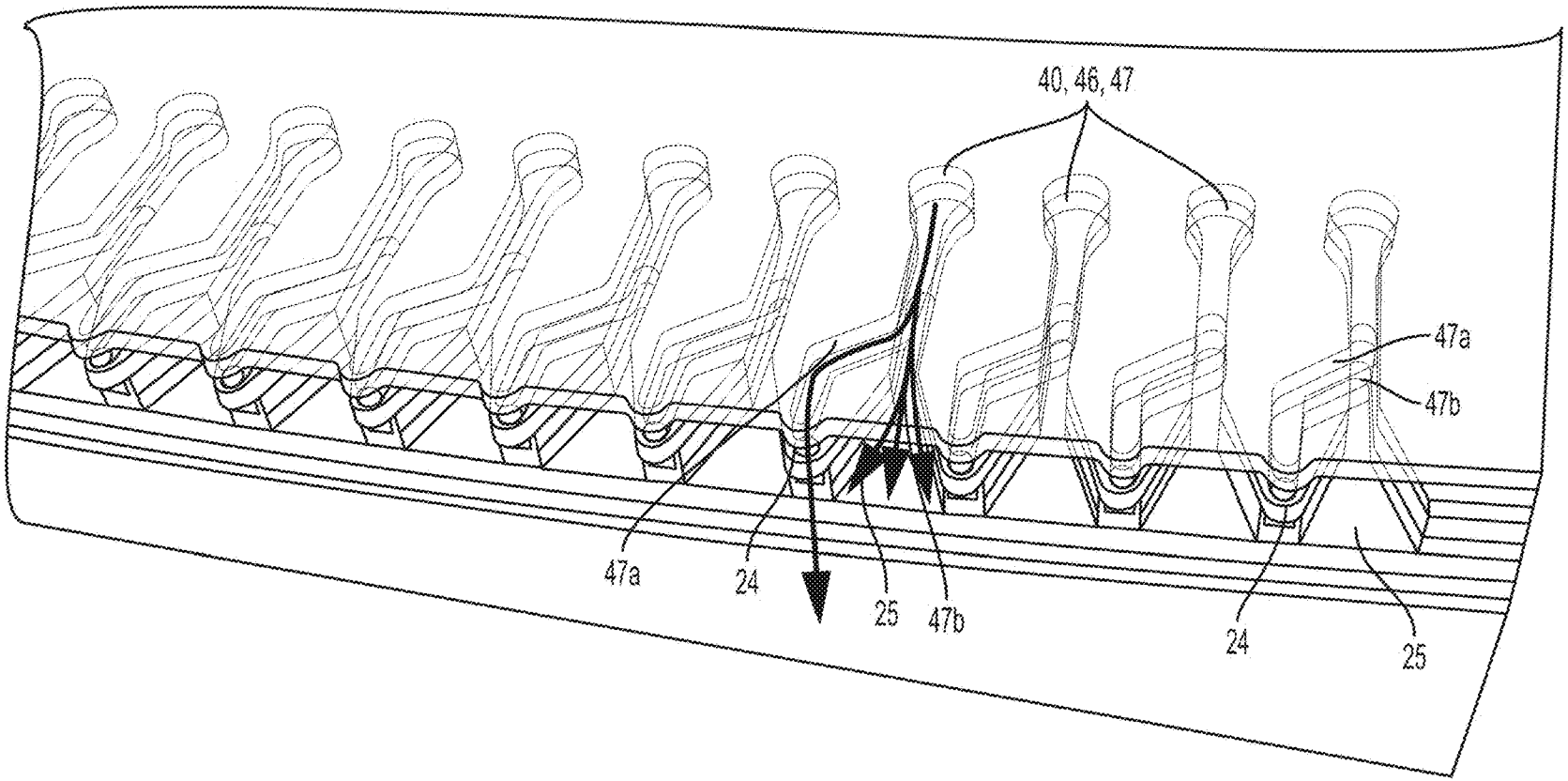
FIG. 14 is an enlarged, translucent view showing interior and exterior components of a nozzle assembly according to an embodiment described herein.
Figure 15:
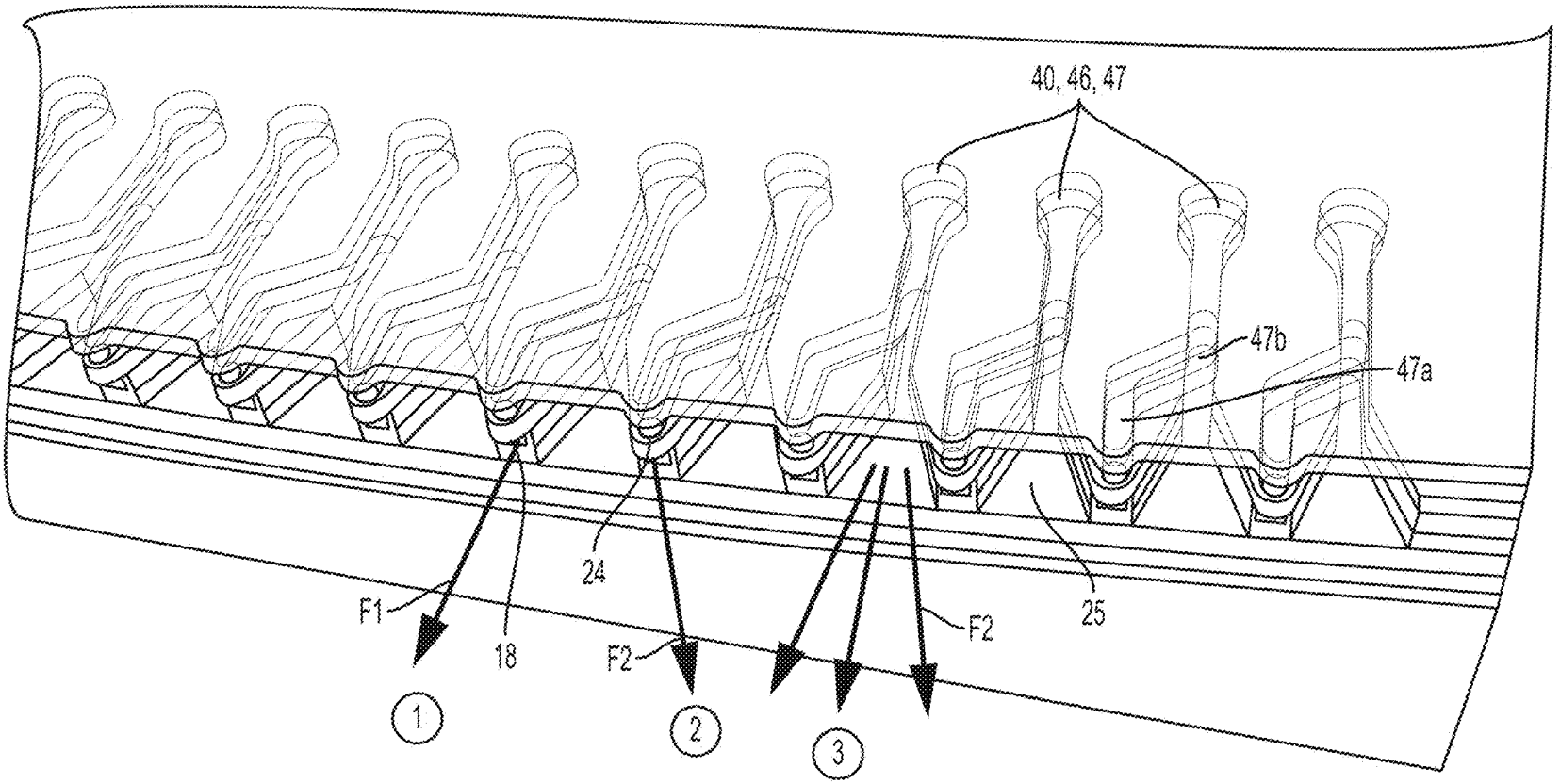
FIG. 15 is an enlarged, translucent view showing interior and exterior components of a nozzle assembly according to an embodiment described herein.

FIGS. 14 and 15 are translucent views showing interior and exterior components of a portion of a nozzle assembly 10 according to the embodiments described herein. As shown in FIGS. 14 and 15, the second fluid conduit 20 may be divided into the plurality of second paths 47 at the second divider portion 46. Each second path 47 may include a barrier arm 47*a* and a spray arm 47*b* configured to direct air to the one or more barrier or second orifices 24 and the one or more spray or third orifices 25, respectively.

Referring again to FIGS. 3-11, as described above, the nozzle assembly 10 includes the plurality of plates 12, including the face plate 26, the backing plate 28 and the laminated nozzle plates 30 positioned between the face plate 26 and the backing plate 28. In one embodiment, shown in FIGS. 8-11, for example, the nozzle assembly 10 may include a first laminated nozzle plate 101, a second laminated nozzle plate 102, a third laminated nozzle plate 103, a fourth laminated nozzle plate 104, a fifth laminated nozzle plate 105, a sixth laminated nozzle plate 106, a seventh laminated nozzle plate 107, an eighth laminated nozzle plate 108, a ninth laminated nozzle plate 109 and a tenth laminated nozzle plate 110.

With further reference to FIGS. 8-11, for example, the first fluid conduit 14 may extend in the first, second, third and fourth laminated nozzle plates 101, 102, 103, 104. In one embodiment, the first reservoir portion 36 may be formed in the first and second laminated nozzle plates 101, 102 and the first divider portion 38 may be formed in the third and fourth laminated nozzle plates 103, 104. The one or more first discharge orifices 18 may be formed in the fifth laminated nozzle plate 105. In one embodiment, the one or more first discharge orifices 18 are formed in a first common, single laminated nozzle plate, such as the fifth laminated nozzle plate 105. Further, as best shown in FIGS. 13-15, in one embodiment, the first discharge orifices 18 may be coplanar with one another. For example, the first discharge orifices 18 may lie in a plane defined by the laminated nozzle plate in which they formed.

Referring to FIGS. 8-15, in one embodiment, the second fluid conduit 20 may extend in each of the first 101 through tenth 110 laminated nozzle plates. The second fluid conduit 20 may additionally extend in the face plate 26. For example, the upper portion 40 may extend in the first 101 through tenth 110 laminated nozzle plates. The connecting portion 42 may be formed in the face plate 26 and is configured to receive the second fluid F2 from the upper portion 40. As shown in FIGS. 8 and 11, the connecting portion 42 may be shaped to extend around fastening holes 48 by including two legs 54 connected to a cross channel 56. The two legs 54 are configured to receive the second fluid F2 from the upper portion 40 and direct the second fluid F2 to the cross channel 56.

The lower portion 44 may be formed in the ninth 109 and tenth 110 laminated nozzle plates and is configured to receive the second fluid F2 from the cross channel 56 of the connecting portion 42. The second divider portion 46, including the second paths 47, may be formed in the seventh 107 and eighth 108 laminated nozzle plates and is configured to receive the second fluid F2 from the lower portion 44. The one or more second discharge orifices 24 may be formed in the sixth 106 laminated nozzle plate. The one or more second discharge orifices 24 are configured to receive the second fluid F2 from the second divider portion 46. The one or more third discharge orifices 25 may be formed in the fourth, fifth and sixth 104, 105, 106 laminated nozzle plates, and are configured to receive the second fluid F2 from the second divider portion 46.

Figure 5:
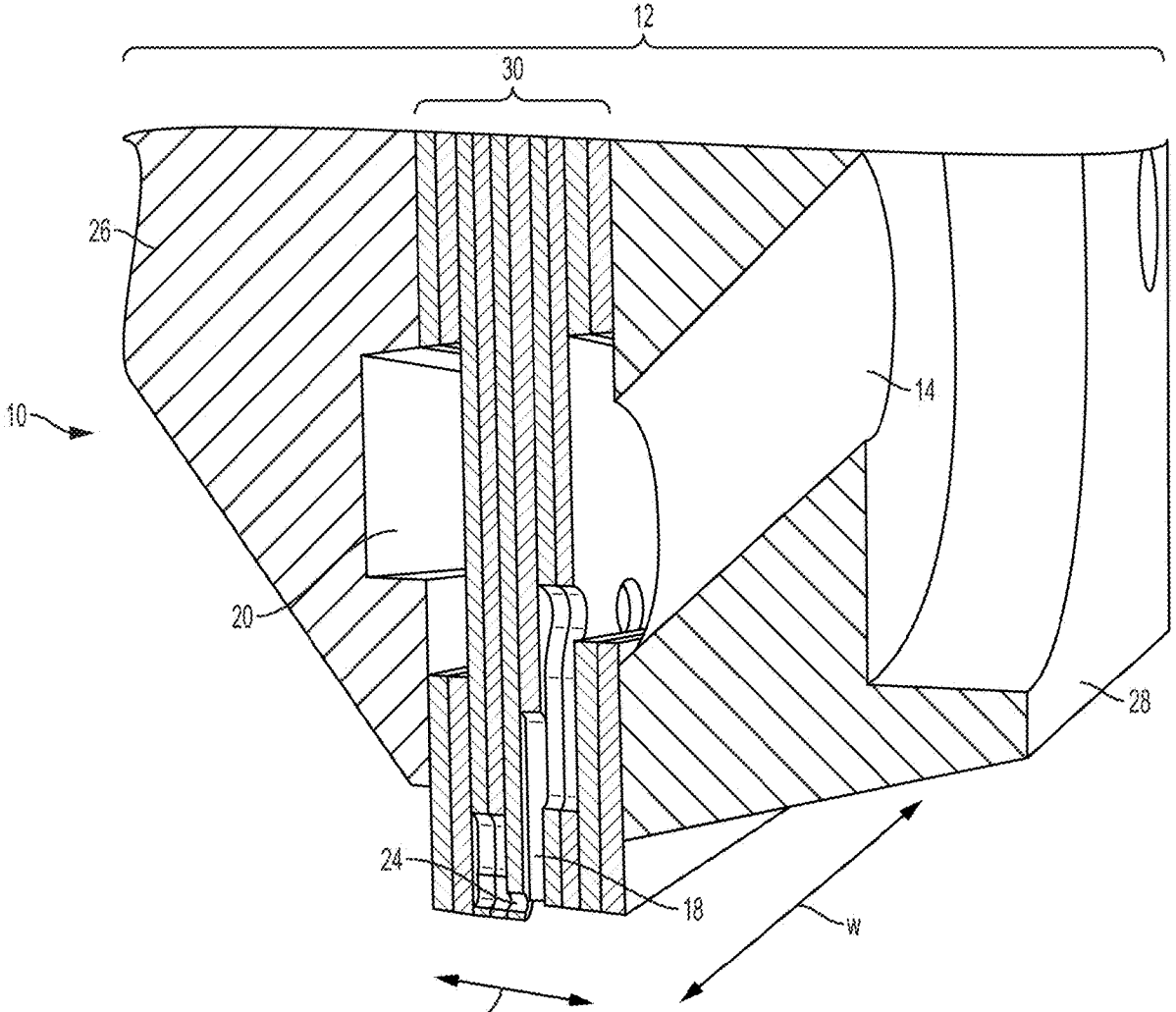
FIG. 5 is a perspective sectional view of a nozzle assembly according to an embodiment described herein.
Figure 6:
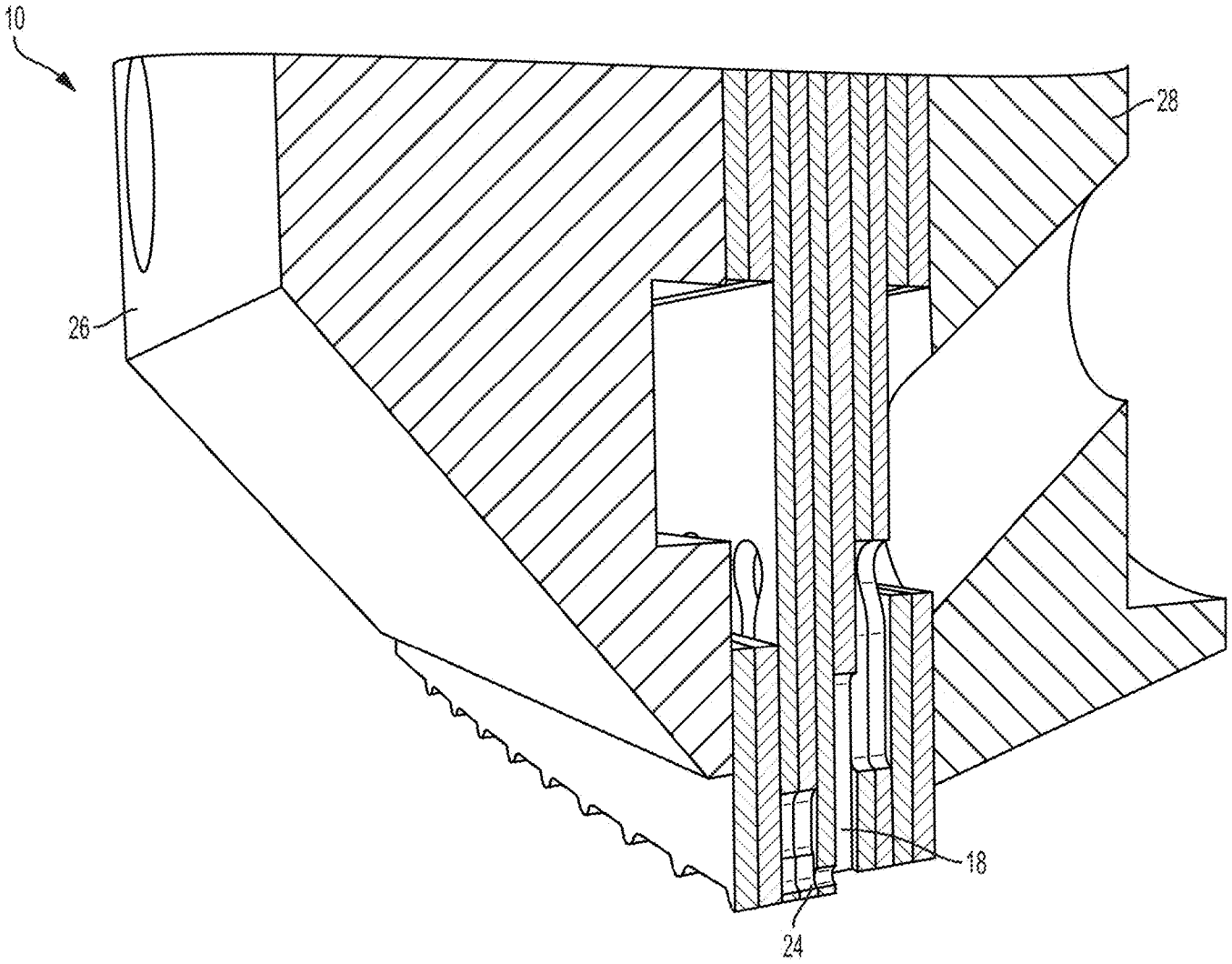
FIG. 6 is another perspective sectional view of the nozzle assembly of FIG. 4.

In one embodiment, the one or more second discharge orifices 24 are formed on a second common, single laminated nozzle plate, such as the sixth laminated nozzle plate 106, different from the first common, single laminated nozzle plate. In the first common, single laminated nozzle plate, the one or more first discharge orifices 18 are formed by a plurality of open ended slots, each slot corresponding to a first discharge orifice 18. Referring to FIGS. 3-8, the slots, or orifices 18, are bound by immediately adjacent plates on both sides in a thickness direction 't' of the nozzle assembly (FIG. 5). Further, in one embodiment, the second discharge orifices 24 may be coplanar with one another. For example, the second discharge orifices 24 may lie in a plane defined by the laminated nozzle plate in which they formed.

The one or more third discharge orifices 25 may be formed in one or more of the laminated nozzle plates. For example, in one embodiment, each of the one or more third discharge orifices 25 may be formed in the first and second common nozzle plates in which the one or more first discharge orifices 18 and one or more second discharge orifices 24 are formed in respectively, along with another adjacent nozzle plate. The third discharge orifices 25 may be aligned in a width direction 'w' of the nozzle assembly 10. The one or more third discharge orifices 25 may be bound by immediately adjacent plates on both sides in the thickness direction 't.' The one or more third discharge orifices 25 may also be formed having a generally triangular shape, so as to increase in width when moving in a direction from an internal position of the nozzle assembly 10 to a perimeter of the nozzle assembly 10. Further, in one embodiment, the third discharge orifices 25 may be coplanar with one another. For example, the third discharge orifices 25 may lie in a plane defined by one or more of the laminated nozzles plate in which they formed.

Referring to FIG. 13, each first discharge orifice 18 of the one or more first discharge orifices 18, formed in the first single, common plate, may be aligned in the width direction 'w' of the nozzle assembly 10. Similarly, each second discharge orifice 24 of the one or more second discharge orifices 24, formed in another single, common plate, may be aligned in the width direction 'w' of the nozzle assembly 10. Further, each first discharge orifice 18 may be aligned with a corresponding second discharge orifice 24 in the thickness direction 't' of the nozzle assembly 10. In one embodiment, the one or more first discharge orifices 18 are positioned on a laminated nozzle plate that is immediately adjacent to, and in abutting contact with, the laminated nozzle plate on which the one or more second discharge orifices 24 are positioned.

Referring to FIGS. 1, 2 and 8-11, for example, the nozzle assembly 10 also includes the one or more fastening holes 48. The fastening holes 48 may extend through each plate of the plurality of plates 12. Each fastening hole 48 is configured to receive a fastener 58, such a bolt, screw, or the like, to secure the plurality of plates 12 together in a tight fit so as seal or substantially seal the nozzle assembly against fluid leakage between the plates. In addition, the nozzle assembly 10 includes one or more machine fastening holes or slots 60, each configured to receive another fastener (not shown), such as a bolt, screw, or the like, to secure the nozzle assembly 10 to an applicator head of a fluid application device or machine (not shown). The machine fastening holes 60 may extend through each plate of the plurality of plates 12.

It is understood that the present disclosure is not limited to the examples above. For example, the laminated nozzle plates 30 between the backing plate 28 and face plate 26 may include additional or fewer laminated plates. For example, the nozzle assembly 10 may be formed with three or more laminated nozzle plates.

Figure 16:
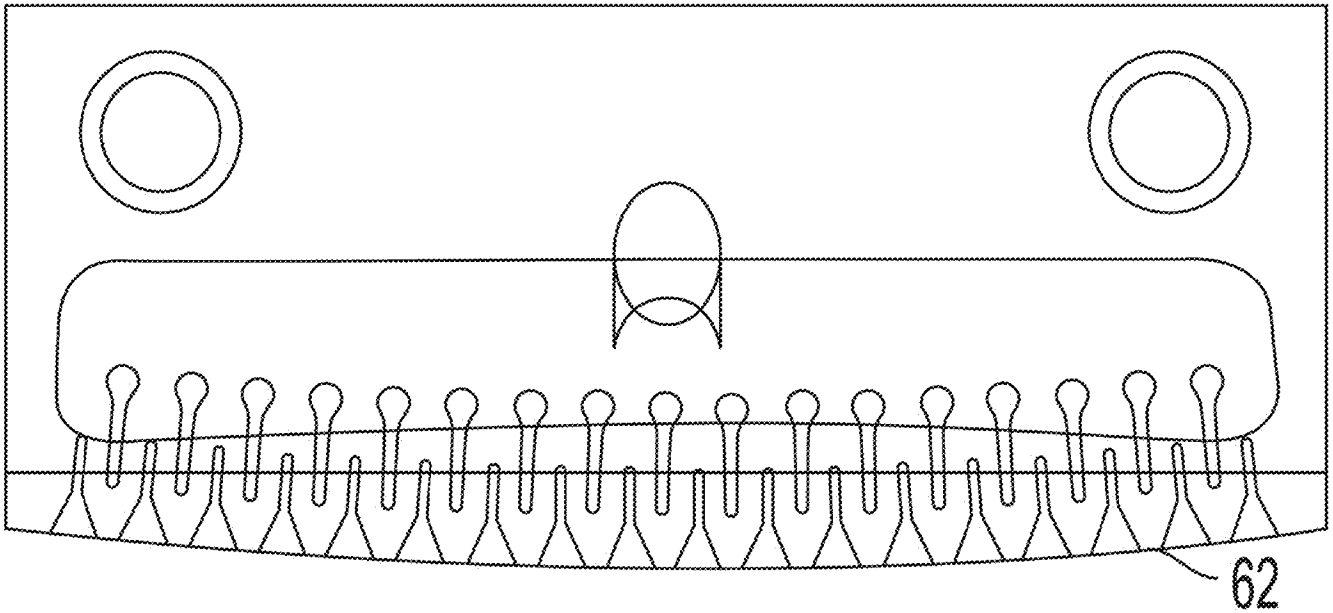
FIG. 16 is a translucent view of a nozzle assembly according to an embodiment described herein.
Figure 17:
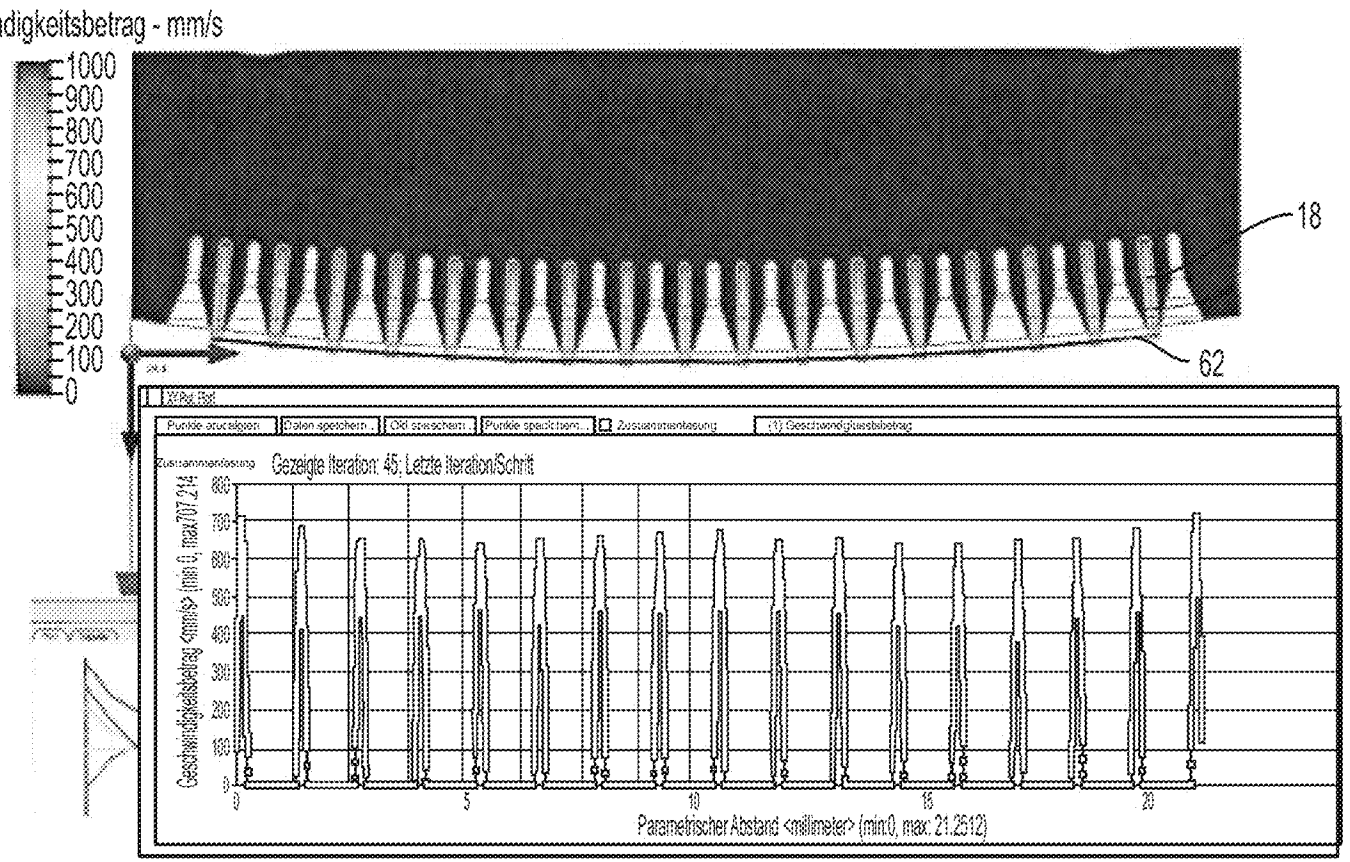
FIG. 17 includes diagrams showing modeling of a nozzle assembly according to an embodiment described herein.
Figure 18:
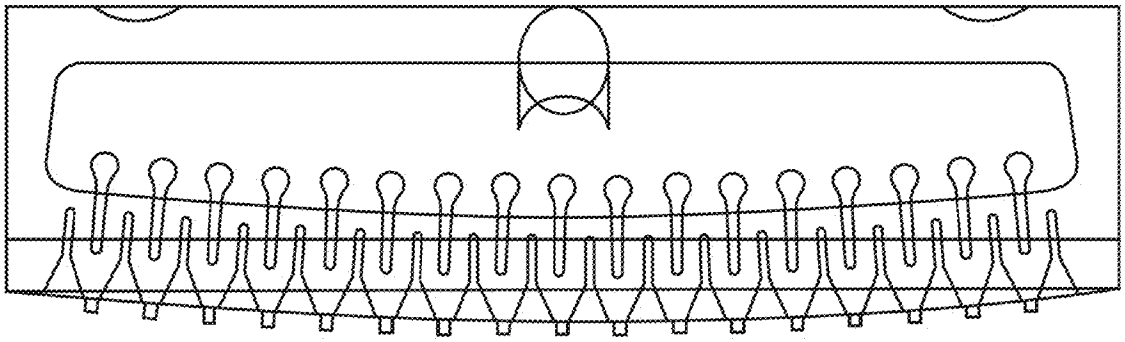
FIG. 18 is a partially transparent view of a nozzle assembly according to an embodiment described herein.
Figure 19:
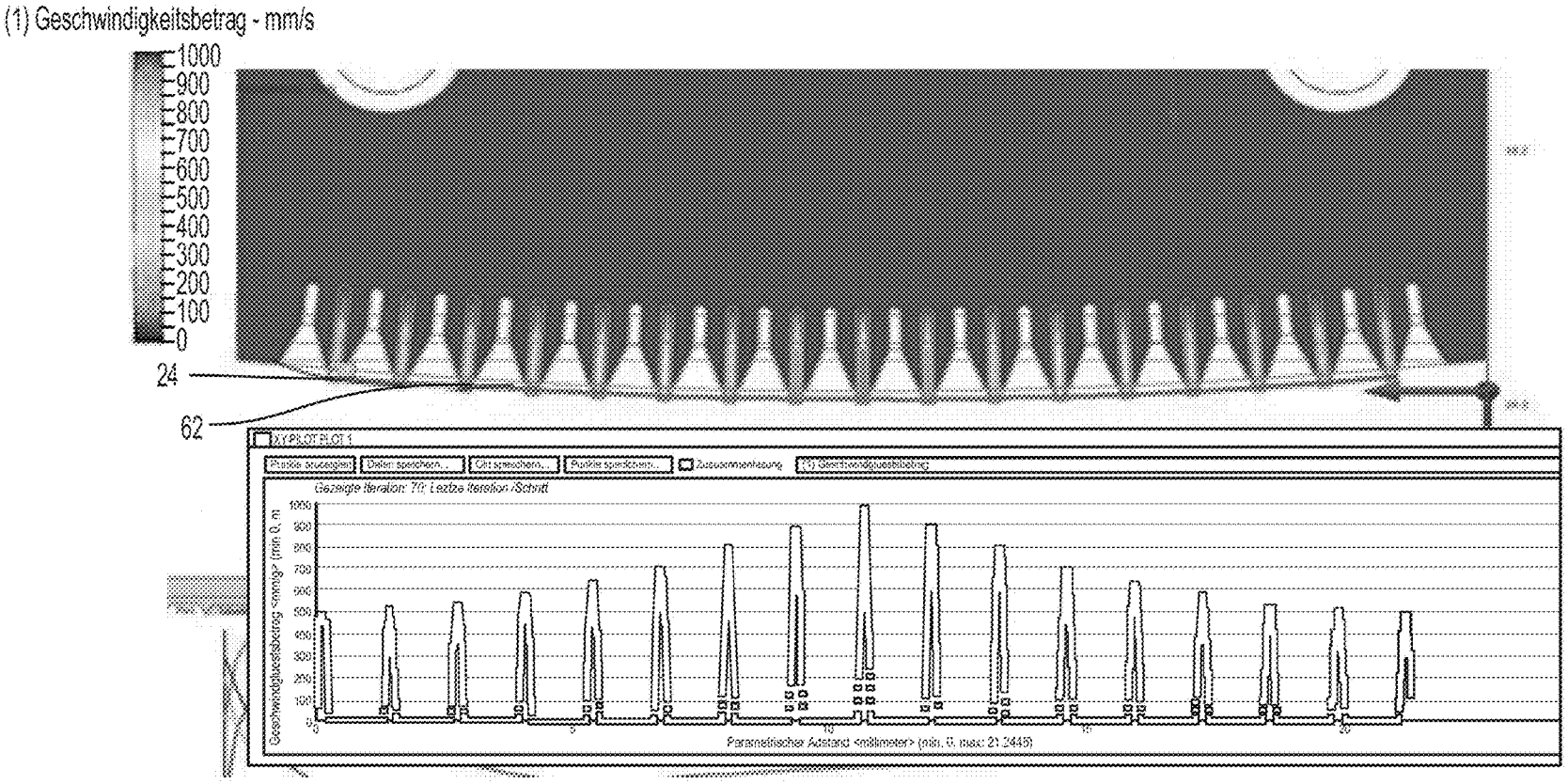
FIG. 19 includes diagrams showing modeling of a nozzle assembly according to an embodiment described herein.

FIGS. 16 and 18 show different translucent views of the nozzle assembly 10, and FIGS. 17 and 19 show Computational Fluid Dynamic ("CFD") models and graphical test results associated with the nozzle assemblies of FIGS. 16 and 18, respectively. Referring to FIGS. 1A, 1C, 8-11, and 16-18, for example, the nozzle assembly 10 may include a generally convex arc or edge region 62. The convex edge region 62 may be formed by convex edges formed on one or more plates of the plurality of plates 12. In one embodiment, the first, second and third discharge orifices 18, 24, 25 may generally be positioned along the convex edge region 62. In addition, portions of the first and second fluid conduits 14, 20, positioned inwardly from the convex edge region 62, may also be positioned along a substantially convex arcuate path. Further still, distal ends of the orifice tips 50 may generally be positioned along the convex edge region 62. In one embodiment, as shown in FIGS. 16 and 17, for example, each first discharge orifice 18 may intersect the arcuate edge 62 at approximately 90 degrees. It is understood that the terminology "generally in the first direction" includes any differences in direction of the discharge of the first fluid F1 that may result from the one or more first fluid discharge orifices 18 being disposed along the convex edge region 62.

Figure 20:
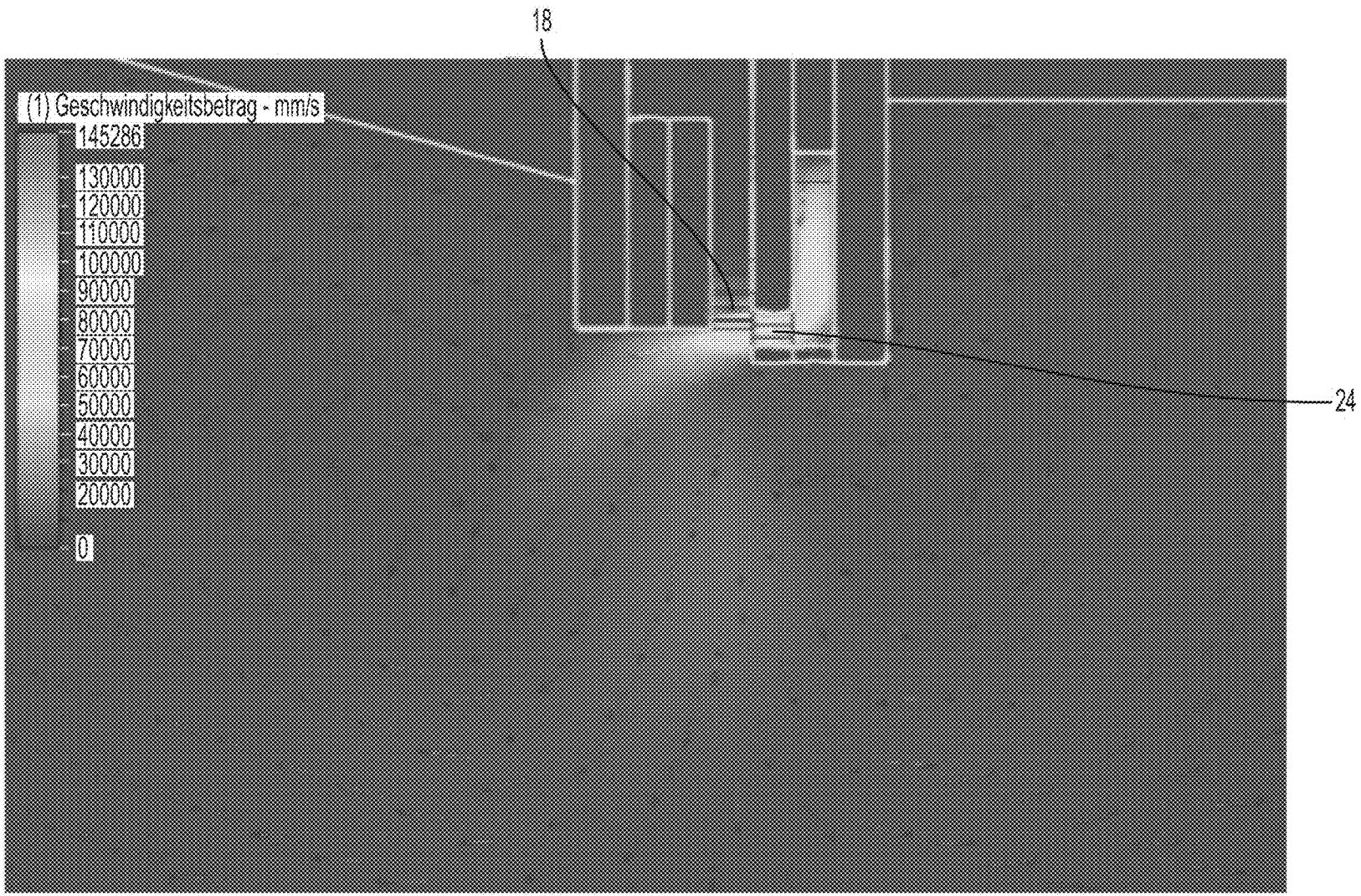
FIG. 20 is a Computational Fluid Dynamic (CFD) model of a cross-section of a nozzle assembly according to an embodiment described herein.
Figure 21:
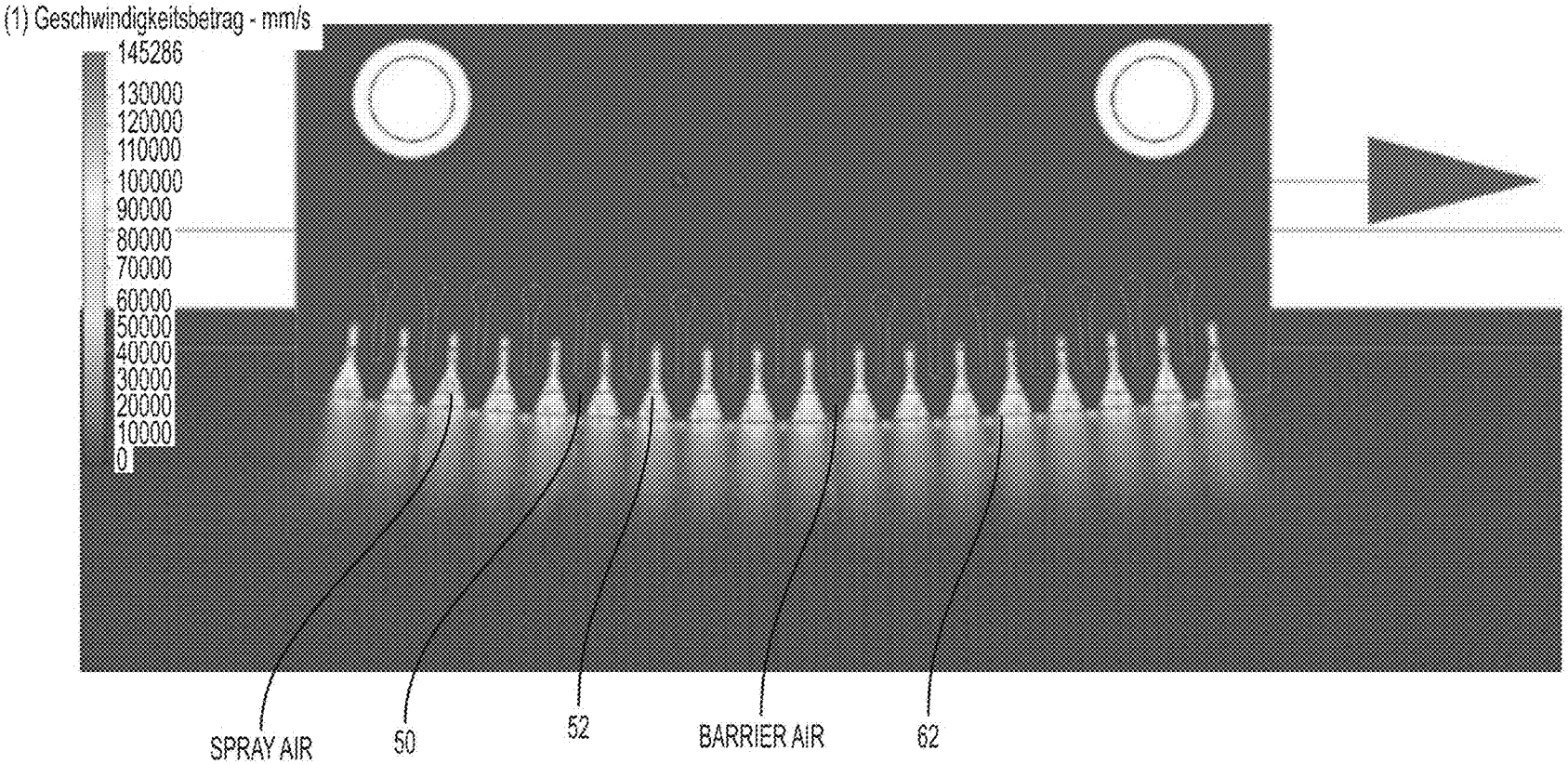
FIG. 21 is a CFD model of a nozzle assembly according to an embodiment described herein.
Figure 22:
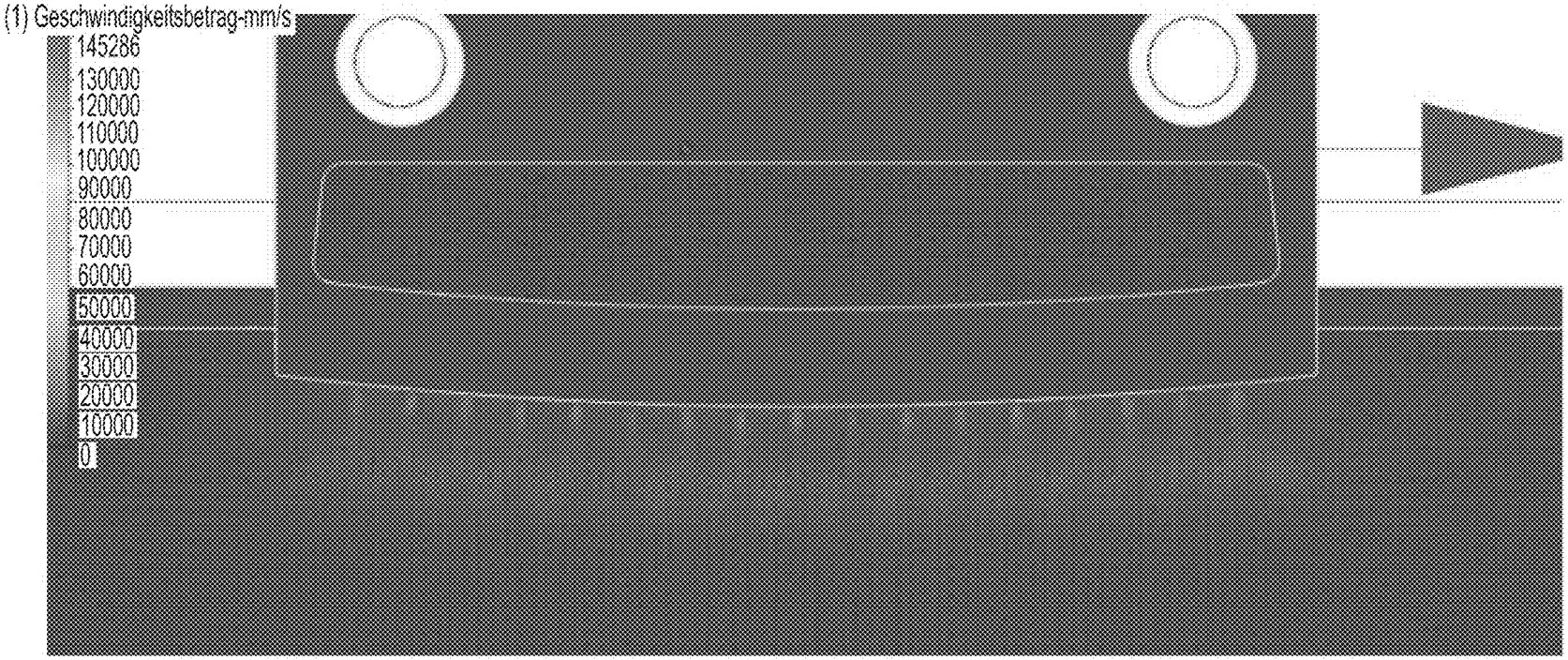
FIG. 22 is a CFD model of a nozzle assembly according to an embodiment described herein.
Figure 23:
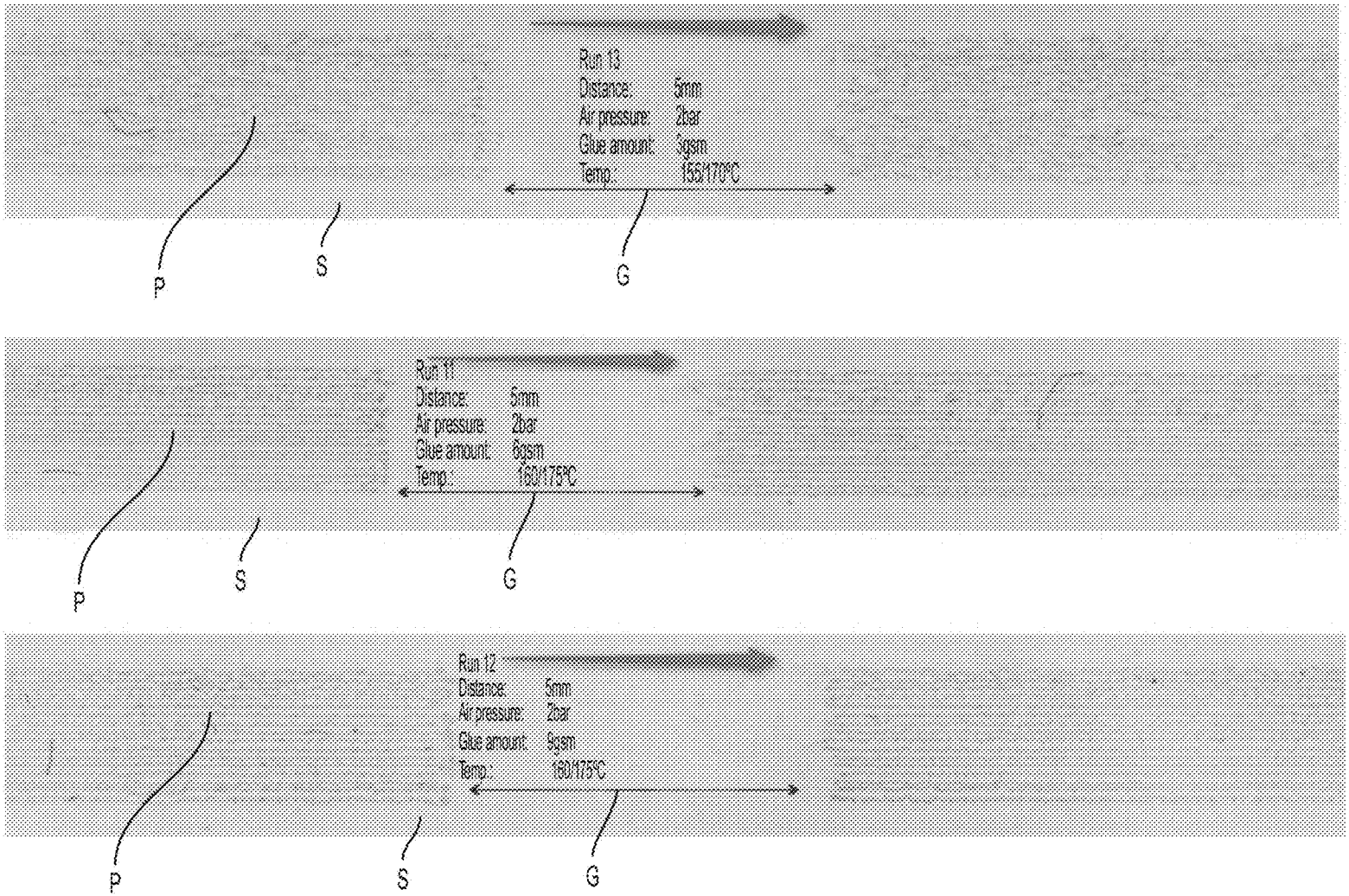
FIGS. 23 and 24 show examples of substrates having a fluid applied thereon by a nozzle assembly according to the embodiments described herein.
Figure 24:
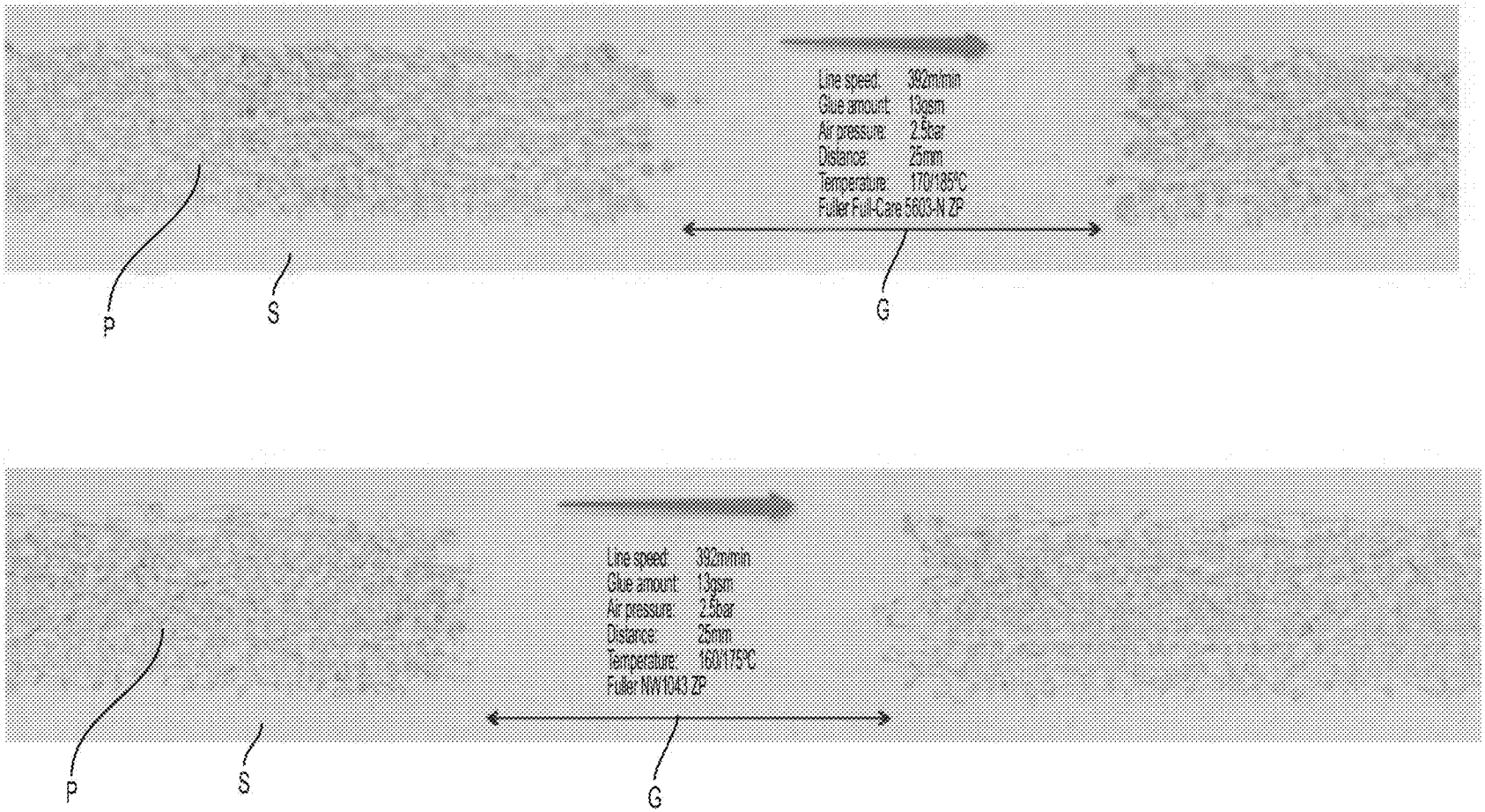

FIGS. 20-22 are different CFD models showing characteristics of second fluid F2 flow from the nozzle assemblies described in the embodiments above. For example, FIG. 20 is a CFD model showing second fluid F2 flow from the one or more second discharge orifices 24 and FIG. 21 is a CFD model showing second fluid flow F2 from the one or more third discharge orifices 25. FIGS. 23 and 24 show first fluid F1 application patterns P on a substrate S achieved with the nozzle assemblies 10 described herein. As shown in FIGS. 23 and 24, a gap G may be provided between application areas on the substrate S by using a second fluid F2, such as air, to cut off the first fluid F1. For example, the second fluid F2 may act as an air knife to cut off the first fluid F1 at the first discharge orifice 18. Application of the first fluid F1 onto the substrate S in the desired pattern, for example, a rectangular pattern, may be partially controlled by the second fluid F2 discharged from the one or more second and third orifices 24, 25.

In the embodiments above a first fluid F1 may be discharged from the one or more first discharge orifices 18 generally in the first direction D1 and the second fluid F2 may be discharged from the one or more second discharge orifices 24 generally in the second direction D2. In addition, the second fluid F2 may be discharged from the one or more third discharge orifices 25 over a range of angles generally in a direction away from the nozzle assembly, for example, generally in the first direction D1, to oscillate or vacillate the first fluid F1 as it is applied to the substrate S. The first fluid F1 may be, for example, a hot melt adhesive. The hot melt adhesive may be discharged from the first discharge orifices 18 as a strand or fiber. The second fluid F2 may be, for example, air, and may operate as an air knife discharged from the one or more second orifices 24 to cut the strand or fiber of hot melt adhesive when it is desired to stop application of the hot melt adhesive onto the substrate. The one or more second discharge orifices 24 may allow the second fluid F2 to flow directly into respective one or more first discharge orifices 18. That is, in the embodiments above, the first and second discharge orifices 18, 24 may be directly, fluidically connected to one another. The second direction D2 may be in the same or an opposite direction as the movement of the substrate S.

Accordingly, the fiber or strand of the first fluid F1 may be cut or separated at each of the one or more first discharge orifices 18 by the air discharged at each of the one or more second discharge orifices 24, and application of the fiber or strand onto the substrate may be accurately controlled. Further, by cutting off the strand or fiber at the first discharge orifice as desired, overspray of the first fluid F1 onto the substrate may be reduced or eliminated and application of adhesive onto product areas intended to be free of adhesive may also be reduced or eliminated. Further still, by accurately controlling stopping and/or starting of the first fluid F1 application onto the substrate, the substrate may be fed past the nozzle assembly 10 at increased line speeds when compared to convention systems.

In addition, during startup, the second fluid F2 discharged from the one or more second and/or third discharge orifices 24, 25 may act on the first fluid F1 (initially in a drop or droplet form) to stretch or fiberize the first fluid F1. Accordingly, undesirably large drops of first fluid F1 onto the substrate S may be reduced during startup. Further still, the second fluid F2 discharged from the one or more second orifices 24 moves the discharge first fluid F1 in the machine direction, i.e., a direction of travel of the substrate, or a direction substantially opposite to the direction of travel. Accordingly, lateral edge definition of an application pattern of the first fluid F1 on the substrate S may be improved by limiting lateral movement of the discharged first fluid.

A method of applying a first fluid to a substrate using a nozzle assembly according to the embodiments described above includes continuously feeding a substrate S past the nozzle assembly 10 and discharging the first fluid F1 from the one or more first discharge orifices 18 in the first direction D1. The method further includes discharging the second fluid F2 from the one or more second discharge orifices 24 in the second direction to cut-off the first fluid F1 at an end of the one or more first discharge orifices 18. The second fluid may also be discharged from the one or more third orifices 25 in a direction generally toward the substrate to oscillate or vacillate the first fluid. The method may further include discharging the first fluid F1 from the one or more first discharge orifices 18 onto the substrate S to provide an intermittent application pattern P of the first fluid on the substrate.

All patents referred to herein, are hereby incorporated herein in their entirety, by reference, whether or not specifically indicated as such within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

The invention claimed is:

1. A nozzle assembly for applying a fluid on a substrate, the nozzle assembly comprising:

a plurality of plates secured together;

a first fluid conduit having a first inlet configured to receive a first fluid;

a first discharge orifice disposed downstream from and in fluid communication with the first fluid conduit, the first discharge orifice open to the atmosphere and configured to discharge the first fluid generally in a first direction;

a second fluid conduit having a second inlet configured to receive a second fluid;

a second discharge orifice disposed downstream from and in fluid communication with the second fluid conduit, the second discharge orifice open to the atmosphere and configured to discharge the second fluid generally in a second direction intersecting the first direction; and a third discharge orifice disposed downstream from and in fluid communication with the second conduit, the third discharge orifice open to the atmosphere and configured to discharge the second fluid to oscillate or vacillate the first fluid during discharge of the first fluid.

2. The nozzle assembly of claim 1, wherein plurality of plates includes a face plate, a backing plate and a plurality of laminated nozzle plates positioned therebetween.

3. The nozzle assembly of claim 2, wherein the first and second inlets are formed in the backing plate.

4. The nozzle assembly of claim 3, wherein the first conduit extends through one or more of the laminated nozzle plates.

5. The nozzle assembly of claim 4, wherein the second conduit extends through all of the laminated nozzle plates.

6. The nozzle assembly of claim 5, wherein the second conduit extends in the face plate.

7. The nozzle assembly of claim 1, wherein the plurality of plates are secured together with one or more fasteners.

8. The nozzle assembly of claim 1, wherein the first direction is angled between 80 and 100 degrees relative to the second direction.

9. The nozzle assembly of claim 8, wherein the first direction is angled approximately 90 degrees relative to the second direction.

10. The nozzle assembly of claim 1, where the first discharge orifice is one of a plurality of first discharge orifices.

11. The nozzle assembly of claim 10, wherein the second discharge orifice is one of a plurality of second discharge orifices.

12. The nozzle assembly of claim 11, wherein the plurality of first discharge orifices are formed in a first single, common plate of the laminated nozzle plates.

13. The nozzle assembly of claim 12, wherein the plurality of second discharge orifices are formed in a second single, common plate of the laminated nozzle plates adjacent to the first single, common plate.

14. The nozzle assembly of claim 13, wherein the laminated nozzle plates extend in a thickness direction and a width direction, the plurality of first discharge orifices are aligned in the width direction, the plurality of second discharge orifices are aligned with the width direction, and each first discharge orifice of the plurality of first discharge orifices is aligned with a respective second discharge orifice of the plurality of second discharge orifices in the thickness direction.

15. The nozzle assembly of claim 14, further comprising a plurality of orifice tips on one or more of the laminated nozzle plates, the orifice tips of each plate being spaced apart in the width direction and having distal ends defining a convex arc.

16. The nozzle assembly of claim 14, wherein the first and second pluralities of discharge orifices are positioned along a convex arc defined by the laminated nozzle plates.

17. The nozzle assembly of claim 1, wherein the first fluid is a hot melt adhesive and the second fluid is air.

18. A method of applying a fluid on a substrate with a nozzle assembly, the nozzle assembly comprising a plurality of plates secured together, a first fluid conduit having a first inlet configured to receive a first fluid, a first discharge orifice disposed downstream from and in fluid communication with the first fluid conduit, the first discharge orifice configured to discharge the first fluid generally in a first direction, a second fluid conduit having a second inlet configured to receive a second fluid, a second discharge orifice disposed downstream from and in fluid communication with the second fluid conduit, the second discharge orifice configured to discharge a second fluid generally in a second direction intersecting the first direction, and a third discharge orifice disposed downstream from and in fluid communication with the second conduit, the third discharge orifice configured to discharge the second fluid to oscillate or vacillate the first fluid, the method comprising:

continuously feeding the substrate by the nozzle assembly;

discharging, in the first direction, the first fluid from the first discharge orifice onto the substrate;

discharging, in the second direction, the second fluid from the second discharge orifice to cut the first fluid discharged from the first discharge orifice at the first discharge orifice; and discharging the second fluid from the third discharge orifice generally in the first direction.

19. The method of claim 18, wherein the first fluid is a hot melt adhesive and the second fluid is air.

20. The method of claim 18, wherein the first discharge orifice is formed in a first plate of the plurality of plates and the second discharge orifice is formed in a second plate of the plurality of plates.

21. The method of claim 18, wherein the substrate is fed in a direction and wherein the second fluid is discharged in a direction parallel to the direction in which the substrate is fed.

22. The method of claim 21, wherein the second fluid is discharged in a same direction as the direction in which the substrate is fed.

23. The method of claim 21, wherein the second fluid is discharged in an opposite direction to the direction in which the substrate is fed.

* * * * *